US007278635B2

(12) United States Patent
Kelly et al.

(10) Patent No.: US 7,278,635 B2
(45) **Date of Patent: *Oct. 9, 2007**

(54) GAME APPARATUS WITH ROTARY INDICATOR AND BONUS MULTIPLIER

(75) Inventors: Bryan M. Kelly, Alamo, CA (US); Norman B. Petermeier, Pleasanton, CA (US); Matthew F. Kelly, San Ramon, CA (US); J. Richard Oltmann, Scottsdale, AZ (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/176,100

(22) Filed: Jun. 19, 2002

(65) Prior Publication Data

US 2003/0015838 A1 Jan. 23, 2003

Related U.S. Application Data

(63) Continuation of application No. 09/695,712, filed on Oct. 23, 2000, now Pat. No. 6,446,964, which is a continuation of application No. 09/351,408, filed on Jul. 9, 1999, now Pat. No. 6,244,595, which is a continuation of application No. 08/995,649, filed on Dec. 22, 1997, now Pat. No. 5,967,514, which is a continuation of application No. 08/428,524, filed on Apr. 21, 1995, now Pat. No. 5,700,007, which is a continuation of application No. 08/176,862, filed on Jan. 3, 1994, now Pat. No. 5,409,225, which is a continuation of application No. 07/956,057, filed on Oct. 2, 1992, now Pat. No. 5,292,127.

(51) Int. Cl.
*A63F 7/00* (2006.01)

(52) U.S. Cl. ..... 273/138.1; 273/118 R; 273/118 A

(58) Field of Classification Search ..... 273/118, 273/123, 138.1, 142.2 B, 118 R, 118 A, 123 R, 273/123 A, 138.2, 142 R, 142 B; 463/1, 463/7, 27

See application file for complete search history.

(56) References Cited

U.S. PATENT DOCUMENTS 473,265 A 4/1892 Reisky (Continued)

FOREIGN PATENT DOCUMENTS

AU 75789/81 4/1982

(Continued)

OTHER PUBLICATIONS

US Registered Trademark No. 1,987,499, registered on Jul. 16, 1996, Mark: Virtual Vegas.

(Continued)

*Primary Examiner*—Raleigh W. Chiu
(74) *Attorney, Agent, or Firm*—Tips Group

(57) ABSTRACT

An arcade game including a progressive bonus apparatus connected to a plurality of individual game units. The progressive bonus apparatus receives score contributions from each game unit to increase a progressive score. When players achieve a predetermined task on a game unit, they receive a non-monetary award based on the progressive score. Each game unit connected to the progressive bonus apparatus may take the form of an arcade-type game with a rotating wheel on which to base scoring. A playing piece is directed down a playing surface towards a target end, and the wheel is rotated according to the target that was hit by the playing piece. The position of the wheel when it stops rotating affects the score. A non-monetary award based on the score is dispensed to the player when the game is completed.

37 Claims, 11 Drawing Sheets

U.S. PATENT DOCUMENTS

| | | | |
|---|---|---|---|
| 810,299 | A | 1/1906 | Pettee |
| 941,194 | A | 11/1909 | Hamilton |
| 1,543,318 | A | 6/1925 | Cardoza |
| 1,563,983 | A | 12/1925 | Higuchi |
| 1,652,071 | A | 12/1927 | Tsujino |
| 1,879,511 | A | 9/1932 | Rodgers |
| 1,912,892 | A | 6/1933 | Eitzen |
| 1,978,395 | A | 10/1934 | Groetchen |
| 2,010,213 | A | 8/1935 | Bergoffen |
| 2,141,580 | A | 12/1938 | White |
| 2,545,644 | A | 3/1951 | Benton et al. |
| 2,660,434 | A | 11/1953 | Durant |
| 2,736,559 | A | 2/1956 | Turner |
| 2,926,915 | A | 3/1960 | Johns |
| 3,268,227 | A | 8/1966 | Thatcher |
| 3,273,571 | A | 9/1966 | Seiden |
| 3,275,324 | A | 9/1966 | Burnside |
| 3,275,325 | A | 9/1966 | MacKenzie |
| 3,285,380 | A | 11/1966 | Sykes |
| 3,362,712 | A | 1/1968 | Wagner |
| 3,429,574 | A | 2/1969 | Williams |
| 3,537,707 | A | 11/1970 | Goldberg |
| 3,584,877 | A | 6/1971 | Florian |
| 3,633,915 | A | 1/1972 | Lippert |
| 3,642,287 | A | 2/1972 | Lally et al. |
| 3,684,290 | A | 8/1972 | Wayne |
| 3,735,987 | A | 5/1973 | Ohki |
| 3,807,736 | A | 4/1974 | Goldfarb |
| 3,819,186 | A | 6/1974 | Hinterstocker |
| 3,834,712 | A | 9/1974 | Cox |
| 3,841,637 | A | 10/1974 | Piazza |
| 3,843,129 | A | 10/1974 | Dietrich |
| 3,851,879 | A | 12/1974 | Hicks |
| 3,947,030 | A | 3/1976 | Goldfarb |
| 3,975,022 | A | 8/1976 | Figueroa |
| 4,058,026 | A | 11/1977 | Simpson |
| 4,095,795 | A | 6/1978 | Saxton et al. |
| 4,101,129 | A | 7/1978 | Cox |
| 4,120,501 | A | 10/1978 | Atherton |
| 4,149,728 | A | 4/1979 | Thompson |
| 4,157,828 | A | 6/1979 | Cosmopulos |
| 4,177,996 | A | 12/1979 | Chang |
| 4,184,683 | A | 1/1980 | Hooker |
| 4,198,052 | A | 4/1980 | Gauselmann |
| 4,200,896 | A | 4/1980 | Baumann |
| 4,212,465 | A | 7/1980 | Arad |
| 4,216,961 | A | 8/1980 | McQuillan |
| 4,227,690 | A | 10/1980 | Pitkanen |
| 4,238,127 | A | 12/1980 | Lucero et al. |
| 4,240,635 | A | 12/1980 | Brown |
| 4,260,153 | A | 4/1981 | Nishimiya |
| 4,321,673 | A | 3/1982 | Hawwass et al. |
| 4,326,351 | A | 4/1982 | Heywood et al. |
| 4,348,028 | A | 9/1982 | Barlow |
| 4,353,554 | A | 10/1982 | Fisher |
| 4,373,727 | A | 2/1983 | Hooker et al. |
| 4,385,847 | A | 5/1983 | Avison |
| 4,397,463 | A | 8/1983 | Moscovich |
| 4,410,178 | A | 10/1983 | Partridge |
| D272,920 | S | 3/1984 | Wichinsky et al. |
| 4,448,419 | A | 5/1984 | Telnaes |
| 4,492,378 | A | 1/1985 | Williams |
| 4,492,379 | A | 1/1985 | Okada |
| 4,496,160 | A | 1/1985 | Wichinsky et al. |
| D278,069 | S | 3/1985 | Wichinsky et al. |
| 4,504,158 | A | 3/1985 | Ciampi et al. |
| 4,508,345 | A | 4/1985 | Okada |
| 4,509,754 | A | 4/1985 | Remmler, deceased et al. |
| 4,515,366 | A | 5/1985 | Hamano |
| 4,519,522 | A | 5/1985 | McElwee |
| 4,534,560 | A | 8/1985 | Okada |
| 4,541,746 | A | 9/1985 | Bobart et al. |
| 4,560,171 | A | 12/1985 | Anthony |
| 4,569,522 | A | 2/1986 | Davies |
| 4,573,681 | A | 3/1986 | Okada |
| 4,602,789 | A | 7/1986 | Chung |
| 4,618,150 | A | 10/1986 | Kimura |
| 4,624,459 | A | 11/1986 | Kaufman |
| 4,635,937 | A | 1/1987 | Dickinson et al. |
| 4,643,425 | A | 2/1987 | Herzenberger |
| 4,648,600 | A | 3/1987 | Olliges |
| 4,657,256 | A | 4/1987 | Okada |
| 4,660,833 | A | 4/1987 | Dickinson et al. |
| 4,662,846 | A | 5/1987 | Quercetti |
| 4,669,731 | A | 6/1987 | Clarke |
| 4,676,506 | A | 6/1987 | Crouch |
| 4,687,981 | A | 8/1987 | Okada |
| 4,695,053 | A | 9/1987 | Vazquez, Jr. et al. |
| 4,700,948 | A | 10/1987 | Okada |
| 4,701,056 | A | 10/1987 | Barlow |
| 4,711,451 | A | 12/1987 | Pajak et al. |
| 4,718,672 | A | 1/1988 | Okada |
| 4,721,307 | A | 1/1988 | Okada |
| 4,732,386 | A | 3/1988 | Rayfiel |
| 4,732,391 | A | 3/1988 | Karr |
| 4,741,532 | A | 5/1988 | Okada |
| 4,743,024 | A | 5/1988 | Helm et al. |
| 4,753,625 | A | 6/1988 | Okada |
| 4,756,531 | A | 7/1988 | DiRe et al. |
| 4,772,023 | A | 9/1988 | Okada |
| 4,772,024 | A | 9/1988 | Werner |
| 4,773,647 | A | 9/1988 | Okada et al. |
| 4,821,863 | A | 4/1989 | Okada |
| 4,822,318 | A | 4/1989 | Okada |
| 4,826,169 | A | 5/1989 | Bessho et al. |
| 4,837,728 | A | 6/1989 | Barrie et al. |
| 4,844,467 | A | 7/1989 | Gyenge et al. |
| 4,848,768 | A | 7/1989 | Barlow |
| 4,852,885 | A * | 8/1989 | Baratpour et al. ..... 273/237 |
| 4,858,932 | A | 8/1989 | Keane |
| 4,861,041 | A | 8/1989 | Jones et al. |
| 4,871,171 | A | 10/1989 | Rivero |
| 4,874,173 | A | 10/1989 | Kishishita |
| 4,889,339 | A | 12/1989 | Okada |
| 4,892,311 | A | 1/1990 | Zaitsu |
| 4,906,005 | A | 3/1990 | Manabe |
| 4,911,449 | A | 3/1990 | Dickinson et al. |
| 4,912,389 | A | 3/1990 | Eguchi |
| 4,930,779 | A | 6/1990 | Maddox |
| 4,948,133 | A | 8/1990 | Helm et al. |
| 4,957,296 | A | 9/1990 | Turnidge |
| 4,961,655 | A | 10/1990 | Saito |
| 4,964,638 | A | 10/1990 | Ishida |
| 4,991,848 | A | 2/1991 | Greenwood et al. |
| 5,002,279 | A | 3/1991 | Kaminkow |
| 5,004,238 | A | 4/1991 | Okada |
| 5,010,995 | A | 4/1991 | Okada |
| 5,014,988 | A | 5/1991 | Mirando |
| 5,014,991 | A | 5/1991 | Mirando |
| 5,016,880 | A | 5/1991 | Berge |
| 5,018,737 | A | 5/1991 | Okada |
| 5,024,439 | A | 6/1991 | Okada |
| 5,024,441 | A | 6/1991 | Rousseau |
| 5,031,911 | A | 7/1991 | Okada |
| 5,042,810 | A | 8/1991 | Williams |
| 5,042,813 | A | 8/1991 | Huang |
| 5,048,833 | A | 9/1991 | Lamle |
| 5,050,881 | A | 9/1991 | Nagao |
| 5,058,893 | A | 10/1991 | Dickinson et al. |
| 5,066,014 | A | 11/1991 | Dobson |
| 5,067,712 | A | 11/1991 | Georgilas |
| 5,071,127 | A | 12/1991 | Bromley et al. |
| 5,074,559 | A | 12/1991 | Okada |
| 5,077,462 | A | 12/1991 | Newell et al. |

| | | | | |
|---|---|---|---|---|
| 5,083,785 | A | 1/1992 | Okada | |
| 5,085,436 | A | 2/1992 | Bennett | |
| 5,096,192 | A | 3/1992 | Stanford | |
| 5,096,196 | A | 3/1992 | Gutknecht et al. | |
| 5,102,134 | A | 4/1992 | Smyth | |
| 5,102,135 | A | 4/1992 | Addiechi | |
| 5,102,136 | A | 4/1992 | Heidel et al. | |
| 5,102,137 | A | 4/1992 | Ekiert | |
| 5,106,091 | A | 4/1992 | Comito | |
| 5,116,055 | A | 5/1992 | Tracy | |
| 5,127,651 | A | 7/1992 | Okada | |
| 5,137,278 | A | 8/1992 | Schilling et al. | |
| 5,149,093 | A | 9/1992 | Schilling et al. | |
| 5,152,529 | A | 10/1992 | Okada | |
| 5,154,421 | A | 10/1992 | Hamano | |
| 5,167,413 | A | 12/1992 | Fulton | |
| 5,178,390 | A | 1/1993 | Okada | |
| 5,181,722 | A | 1/1993 | Krutsch | |
| D332,976 | S | 2/1993 | Gutknecht et al. | |
| 5,184,821 | A | 2/1993 | Korenek | |
| 5,188,363 | A | 2/1993 | Marnell, II et al. | |
| 5,205,555 | A | 4/1993 | Hamano | |
| 5,209,479 | A | 5/1993 | Nagao et al. | |
| 5,219,167 | A | 6/1993 | Hamano | |
| 5,249,800 | A | 10/1993 | Hilgendorf et al. | |
| 5,259,616 | A | 11/1993 | Bergmann | |
| 5,280,909 | A | 1/1994 | Tracy | |
| 5,286,023 | A | 2/1994 | Wood | |
| 5,292,127 | A * | 3/1994 | Kelly et al. | 273/118 A |
| 5,342,049 | A | 8/1994 | Wichinsky et al. | |
| 5,344,144 | A | 9/1994 | Canon | |
| 5,344,145 | A | 9/1994 | Chadwick et al. | |
| 5,362,052 | A | 11/1994 | Kubatsch | |
| 5,370,306 | A | 12/1994 | Schulze et al. | |
| 5,374,061 | A | 12/1994 | Albrecht | |
| 5,380,008 | A | 1/1995 | Mathis et al. | |
| 5,385,347 | A * | 1/1995 | Halliburton | 273/142 R |
| 5,393,057 | A | 2/1995 | Marnell, II | |
| 5,393,061 | A | 2/1995 | Manship et al. | |
| 5,401,024 | A | 3/1995 | Simunek | |
| 5,409,225 | A * | 4/1995 | Kelly et al. | 273/118 A |
| 5,411,271 | A | 5/1995 | Mirando | |
| 5,486,005 | A | 1/1996 | Neal | |
| 5,540,442 | A | 7/1996 | Orselli et al. | |
| 5,700,007 | A * | 12/1997 | Kelly et al. | 273/118 A |
| 5,743,523 | A * | 4/1998 | Kelly et al. | 273/118 A |
| 5,779,549 | A | 7/1998 | Walker et al. | |
| 5,788,573 | A | 8/1998 | Baerlocher et al. | |
| 5,839,957 | A | 11/1998 | Schneider et al. | |
| 5,848,932 | A | 12/1998 | Adams | |
| 5,882,261 | A | 3/1999 | Adams | |
| 5,911,418 | A | 6/1999 | Adams | |
| 5,967,514 | A * | 10/1999 | Kelly et al. | 273/118 A |
| 6,244,595 | B1 * | 6/2001 | Kelly et al. | 273/138.1 |
| 6,491,296 | B2 * | 12/2002 | Kelly et al. | 273/118 A |

FOREIGN PATENT DOCUMENTS

| | | | |
|---|---|---|---|
| AU | A-48825/85 | | 10/1984 |
| AU | 24895/92 | | 5/1995 |
| DE | 2252053 | | 5/1974 |
| DE | 2824863 | B1 | 11/1979 |
| DE | 7931812 | U | 2/1980 |
| DE | 2838339 | A1 | 3/1980 |
| DE | 2909527 | B1 | 6/1980 |
| DE | 3105266 | A1 | 9/1982 |
| DE | 3229673 | A1 | 2/1984 |
| DE | 3347508 | | 7/1985 |
| DE | 3424383 | A1 | 1/1986 |
| DE | 3439636 | | 4/1986 |
| DE | 3436783 | | 5/1986 |
| DE | 3601631 | | 7/1987 |
| DE | 3601824 | A1 | 7/1987 |
| DE | 3700861 | A1 | 7/1988 |
| DE | 3700861 | C2 | 7/1988 |
| DE | 3709026 | A1 | 9/1988 |
| DE | 3726495 | | 2/1989 |
| DE | 3738120 | A1 | 5/1989 |
| DE | 3811301 | | 10/1989 |
| DE | 3831740 | | 3/1990 |
| DE | 3917684 | | 12/1990 |
| DE | 4014477 | | 7/1991 |
| DE | 4014477 | A1 | 7/1991 |
| EP | 0 062 433 | A2 | 10/1982 |
| EP | 0577415 | A2 | 1/1994 |
| EP | 0577415 | A3 | 1/1994 |
| EP | 0603230 | B1 | 6/1994 |
| ES | U 8601125 | | 11/1986 |
| ES | U 8703519 | | 11/1987 |
| ES | U 8703530 | | 11/1987 |
| ES | U 8701723 | | 6/1988 |
| ES | U 8701028 | | 3/1989 |
| ES | 2016168 | | 10/1990 |
| GB | 371199 | | 4/1932 |
| GB | 912685 | | 12/1962 |
| GB | 1430007 | | 3/1976 |
| GB | 1464896 | | 6/1977 |
| GB | 1550732 | | 8/1979 |
| GB | 2081952 | A | 2/1982 |
| GB | 2092797 | A | 8/1982 |
| GB | 2 096 376 | A | 10/1982 |
| GB | 2097160 | A | 10/1982 |
| GB | 2106291 | A | 4/1983 |
| GB | 2 201 821 | A | 9/1988 |
| GB | 2233806 | A | 1/1991 |
| GB | 2253300 | A | 9/1992 |
| GB | 2264815 | A | 1/1994 |
| JP | 49105640 | | 10/1974 |
| JP | 5955272 | | 3/1984 |
| JP | 60-227787 | | 11/1985 |
| JP | 62-253091 | | 11/1987 |
| JP | 62-254786 | | 11/1987 |
| JP | 3-136683 | | 6/1991 |
| JP | 5237217 | | 9/1993 |
| JP | 6-190114 | | 7/1994 |
| JP | 6-254208 | | 7/1994 |
| NL | 9200335 | | 9/1992 |
| WO | 82/01611 | | 5/1982 |
| WO | 91/17529 | | 11/1991 |
| WO | WO91/17529 | | 11/1991 |
| WO | 93/05484 | | 3/1993 |

OTHER PUBLICATIONS

Coin Slot, Jan. 27, 1979, p. 32, IGT 58595.

Coin Slot, Jan. 24, 1986, p. 14, IGT 58601.

Document describing "Wheel of Fortune" and "Wheel Deal" games, document refers to dates of Oct. 1981 and Jan. 1982, IGT 59466-59467.

Document describing "Money Wheel" game, document refers to date of Jan. 1979, IGT 59470, 59471.

Coin Slot, Jan. 13, 1979, p. 21, IGT 58593.

Document describing "Seven Up" game, document refers to date of May 1987, IGT 59482, 59484.

Document stating ODDBALLS—Various machines with 'discs' on them, IGT 59486 and additional page showing "Risk Disks" game, undated, IGT 59487.

Exhibit A, two unidentified pages of photographic images showing slot machines.

"Old Ideas Make New Ideas," Loose Change, Sep. 1996, pp. 22-24.

Club Reno & Club Vegas, JPM Automated Machines, Ltd., 1991.

JPM Royal 50.

Jerry Ayliffe, American Premium Guide to Jukeboxes and Slot Machines (Krause 3d ed. 1991), 11 pages.

Dieter Ladwig, Slot Machines (Phil Goddard trans., Chartwell 1992), 10 pages.

Bill Kurtz, Slot Machines and Coin-Op Games (Quantum 1997), 5 pages.
Topsy Turvy (IGT): Front page of IGT Slot Line magazine, Jul./Aug. 1990, and enlarged image of Topsy Turvy machine.
Jokers Wild (JPM): EuroSlot, Jun. 1992, front page and 3 additional pages.
EuroSlot, Mar. 1992, front page, contents page, p. 48.
EuroSlot, Jun. 1992, front page, contents page, 3 additional pages.
EuroSlot, Sep. 1992, front page, contents page, additional page.
Document describing "Chase the Lady" game, document refers to date of Nov. 1988, IGT 059480.
Document describing "Chase the Lady" game, undated, IGT 059481.
Unidentified portion of article showing "Crazy Fruit" game, undated, IGT 059488.
Portion of article from Coin Slot, dated Mar. 1990, which appears to show "Multi-Money" game (in left hand picture), IGT 059490, IGT 059491.
Unidentified portion of article showing "Thesis Casino" game, undated, IGT 059472.
Document showing Starstruck and "Carnival" games, undated, IGT 059497.
Document showing "Lucky Casino" game, undated, IGT 059499-059500.
Document showing "Spun Gold" game, undated, IGT 059502.
Document showing "Spin Ball" game, undated, IGT 059504.
Document showing "Double Dice" game, undated, IGT 059506.
Document showing "Fun Fair" game, undated, IGT 059508.
Document showing "Space Fruits" game, undated, IGT 059509, IGT 058594.
Document showing "Fortune Wheel" game, undated, IGT 059511.
Pages from Coin Slot, handwritten date Jan. 26, 1990, IGT 059512-059513.
Document showing "Fortune Wheel" game, IGT 059834.
Documents describing "Ten/Twenty" game, undated, IGT 058591.
Documents showing "New Orleans" game, undated, IGT059487-059848.
Document showing "Reel Roulette" game, undated, IGT 059849.
Document showing "Zodiaco" game, undated IGT 059850.
4-page document entitled "The Complete AWP Package from JPM," undated, IGT 059851-059854.
Documents showing "Filthy Rich" game, undated, IGT 059859-059860.
Documents describing "Win Pot" game, undated, IGT 059867-059868.
Document describing "Fortune Wheel" game, undated, IGT 059870-059872.
Documents showing "Monopoly" and other games, Nov./Dec. 1992, IGT 059845-059846.
Article entitled "Pub models out of the woods . . . ," undated, IGT 058600.
Document showing "Top Strike" game, undated, IGT 058607.
Document showing "Take the Money" game, undated, IGT 058608.
Document showing "Break the Bank" game, undated, IGT 058609.
Robert N. Geddes, Slot Machines on Parade (Mead 1980), 19 pages.
Opposition of Australian Appl. No. 58011/01: Claims being opposed. (BB6).
Bally S500 Slot Machine Reels and Controllers (9 pages).
Demand for Jury Trial (US Dist. Ct. Case No. 3:06-CV-00483-ECR-(RAM) (12 pages).
JOB23609-1QUIN-Spanish, "*Cirsa Fortuna*", Universal de Desarrolos Electronicos S.A. (Cirsa Fortuna)(C) Mar. 16, 2007, 21 pgs. (translated).
JOB23609-3QUIN-Spanish, "*Cirsa Tivoli*", Universal de Desarrolos Electronicos S.A. (Cirsa Tivoli)(C) Mar. 16, 2007, 23 pgs. (translated).
JOB23609-5QUIN-Spanish(Picture 1) "Cirsa Fortune" (translated).
JOB23609-5QUIN-Spanish(Picture 2) "Cirsa Club Multiplier" (translated).
JOB23609-5QUIN-Spanish(Picture 3) "Cirsa Club" (translated).
Document (photo) showing "Cyclone," undated (3 pages).
Document showing "Topsy Turvy," undated, IGT1005139.
Cyclone Pinball by Williams 1989 at www.pinballrebel.com, downloaded from website http://www.pinball rebel.com/game/pins/cycline/cyclone_pinball.htm, printed on Apr. 18, 2007 (19 pages).
Cyclone Parts Information Manual, Mar. 1988, IGT1004716 - IGT1004737 (22 pages).
Cyclone, Williams Electronics Games, Inc., IGT1004585 (1 page).
Cyclone, "It'll Blow You Away," IGT1004586 (1 page).
Pinball Archive Rule Shhet: Cyclone, IGT1004633 - IGT1004636, (4 pages).
Cyclone Operations Manual, Feb. 1988 (66 pages).
Bally Speakeasy Installation and General Game Operation Instructions, IGT1010170 - IGT 1010208 (39 pages).
Riverboat Gambler Pinball of 1990 by Williams at www.pinballrebel.com, IGT1008872 - IGT1008879 (8 pages).
Pinball Archive Rule Sheet: Riverboat Gambler IGT1008880 - IGT1008893, (14 pages).
Amendment, Riverboat Gambler Operations Manual, IGT1008894 - IGT1008910, (17 pages).
The Internet Pinball Machine Database, Riverboat Gambler/ IPD No. 1966/Nov. 1990,/ 4 players, from website http://ipdb.org/search/pl?any=Riverboat+&sortby+name&searchtype+1. . . , printed on Jan. 4, 2007 (2 pages).
Riverboat Gambler Rulesheet, HTML Version 1.53, Scott Piehler, IGT1010074 - IGT1010098 (25 pages).
Riverboat Gambler Rulesheer v.2.93, from website http://www.ipdb.org/rulesheets/1966/RGAMBER.TXT, printed on Jan. 4, 2007, IGT1010099 - IGT1010115 (17 pages).
Riverboat Gambler Quick-Take, from website http://www.ipdb.org/rulesheets/1966/RGAMBQT.TXT, printed on Jan, 4, 2007, IGT1010116 - IGT1010117 (2 pages).
Amendment, Riverboat Gambler Operations Manual, IGT1010133 - IGT1010134 (2 pages).
Internet Pinball Databse: Williams 'Riverboat Gambler,' IGT1008834 - IGT1008836 (3 pages).
THe Internet Pinball Machine Database from website http://ipdb.org/search,pl?any=Bad+Cats&search=Search+Database&sea. . . printed on Jan. 4, 2007, ITG1009847 - IGT1009849 (3 pages).
Bad Cats Rulesheet Version1.01 by Bill Ung, from website http://www.ipdb.org/rulesheets/127/badcats.htm, printed on Jan. 4, 2007, IGT1009850 - IGT1009856 (7 pages).
Internet Pinball Database: Williams 'Bad Cats', ITG1010162 - IGT101063 (2 pages).
Pinball Archive Rule Sheet: Bad Cats, IGT101064 - IGT1010169 (7 pages).
Bad Cats Operations manual, Nov. 1989, IGT1009857 - IGT1009903 (47 pages).
Davis, Bradley, "Mastering Joker Wild Video Poker," Applied Technology Press, IGT1004213 - IGT1004216 (4 pages).
JPK Royal 50, undated, IGT1004365 - IGT1004366 (2 pages).
Fey, Marshall, The Complete Service Manual For Series E 1980 - 1986, Libert Belle Books, Front pages, Contents page, and one additional page, IGT1007394 - IGT1007396 (3 pages).
Smokin' Token, Seidel Amusement Machine Co., Inc., undated, IGT1005199 - IGT1005200 (2 pages).
RePlay Magazine, Spotlight Special, "Wanna Hook Onto a Tavern Hit? Call Your Benchmark Distriutor," Feb. 1996, IGT1005206 - IGT1005209 (4 pages)
Convoy Operations Manaul, Taito Corporation, undated, IGT1005249 - IGT1005272 (24 pages).
Fey, Marshall, "*Bally* Slot Machines," Cover page and one additional page, IGT1007397 - IGT1007398 (2 pages).
Document showing Bromley's line of Family Entertainment, undated, IGT1005211 - IGT1005212 (2 pages).
Document showing "Circus Roll," undated, IGT1005213 (1 page).
Document showing "Clain Jumper," undated, IGT1005214 (1 page).
Document showing games from Benchmark Games, Inc., undated, IGT1005205 (1 page).
Document showing "Caribbean Hook," undated, IGT1005210(1 page).
Document showing "Dozers," undated, IGT1005201 (1 page).
Document showing "Cheese Chase", undated, IGT1005215 (1 page).

Document showing "Lot-o-Fun," undated, IGT1005220 (1 page).
Document showing "Pirates Revenge," undated, IGT1005221 (1 page).
Document showing "Redemption Income," undated, IGT1005222 (1 page).
Document showing "Convoy," undated, IGT1005248 (1 page).
Document showing "Over the Rainbow," undated, IGT1005276 (1 page).
Document showing "Double Cheese," undated, IGT1005275 (1 page).
Klov, "Killer List of Video Games," from website http://www.klov.com/game_detail.php?game_id=7616, printed on Oct. 3, 2006, IGT1005273 - IGT1005274 (2 pages).
FiveStarRedemption Products Page, from website http://www.firestarredemption.com/products.htm, printed on Oct. 3, 2006, IGT1005216 - IGT1005217 (2 pages).
Games, from website http://www.greatersouther.com/manufacturers/baytek.html, printed on Oct. 3, 2006, IGT1005242 - IGT1005247 (6 pages).
Document showing "Vegas and Club Reno," undated, IGT1004364 (1 page).
Document showing "Lucky Strike," undated, IGT1004452 (1 page).
Document showing "Lucky Strike," undated, IGT1004453 (1 page).
"What is PLUS Lotto?" from website http://www.pluslotto.com/newpl_content.asp?page+who&sid=249FA554D1F&cr=151018, printed on Feb, 28, 2000, IGT1004357 (2 pages).
Robert N. Geddes, Slot Machines on Parade (Mead 1980), IGT1004408 - IGT1004426 (19 pages).
Document showing "Jive Time," undated, IGT1006772 (1 page).
Document showing "Ticket Track," undated, IGT1005202 (1 page).
Document showing "Quack Attack," IGT1005203 - IGT1005304 (2 pages).
Document showing "Slam Ramp," undated, IGT1005218 (1 page).
Document showing "No-Good Golfers," undated, IGT1005219 (1 page).
Document showing 'Bad Cats', Upper Playfield, from website http://ipdb.org/showpic.pl?id=127&picno+9839, printed Jan. 4, 2007, IGT1009917 (1 page).
Document showing 'Bad Cats', Center Playfield, from website http://ipdb.org/showpic/pl?id=127&pinco+9840, printed Jan.4, 2007, IGT1009918 (1 page).
Document showing 'Bad Cats', Lower Playfield, from website http://ipdb.org/showpic.pl?id=127&picno+9841, printed Jan, 4, 2007, IGT1009919 (1 page).
Document showing 'Bad Cats', Backglass Animation Detail, from website http://ipdb.org/showpic.pl?id=127&picno+9843, printed Jan. 4, 2007, IGT1009920 (1 page).
Document showing 'Bad Cats', Playfield, from website http://ipdb.org/showpic.pl?id=127&picno+28928, printed Jan. 4, 2007, IGT1009921 (1 page).
Document showing 'Riverboat Gambler', Production Translite, from website http://ipdb.org/showpic.pl?id=1966&pinco=18626, printed Jan. 4, 2007, IGT1010135 (1 page).
Document showing 'Riverboat Gambler', Duratrans Prototype, from website http://ipdb.org/showpick.pl?id=1966&picno=18627, printed Jan. 4, 2007, IGT1010136 (1 page).
Document showing 'Riverboat Gambler', Playfield, from website http://ipdb.org/showpick.pl?id=1966&picno=14863, printed Jan. 4, 2007, IGT1010137 (1 page).
Document showing 'Riverboat Gambler', Backglass, from website http://ipdb.org/showpick.pl?id=1966&picno=19491, printed Jan. 4, 2007, IGT1010138 (1 page).
Document showing Beat the Clock, undated, IGT1010301 - IGT1010302 (2 pages).
Document showing "Cyclone," undated, IGT1004645 - IGT1004649 (5 pages).
Melton, Wayne, "Giant Machines Reap Gamblers," Reno Gazzette-Journal, Feb. 24, 1992, IGT1007383 (1 page).
IGT's Disclosures Pursuant to Photograph 3(b) of the Joint Discovery Plan and Scheduling Order (with Exhibits 1-15).
Document (photo) showing large slot machine, undated, IGT1005560.
Document (photo) showing slot machine labeled SMB $5.00, undated, IGT1005568.
Document (photo) showing "Topsy Turvy," undated, IGT1004746.
Document (photo) showing "Topsy Turvy," labeled as Apr., 1990, IGT1004747.
Document (photo) showing "Mad Money" large slot machine, undated, IGT1005570.
Document (photo) showing "Harrah's" large slot machine, undated, IGT1005572.
Documents (photos and negatives) showing large slot machine, undated, IGT1005576-77, 79-83.

* cited by examiner

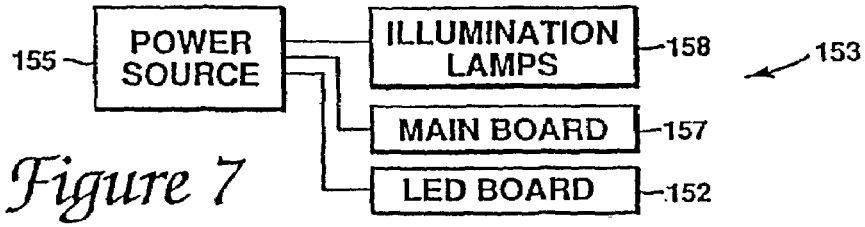
Figure 7
Figure 8
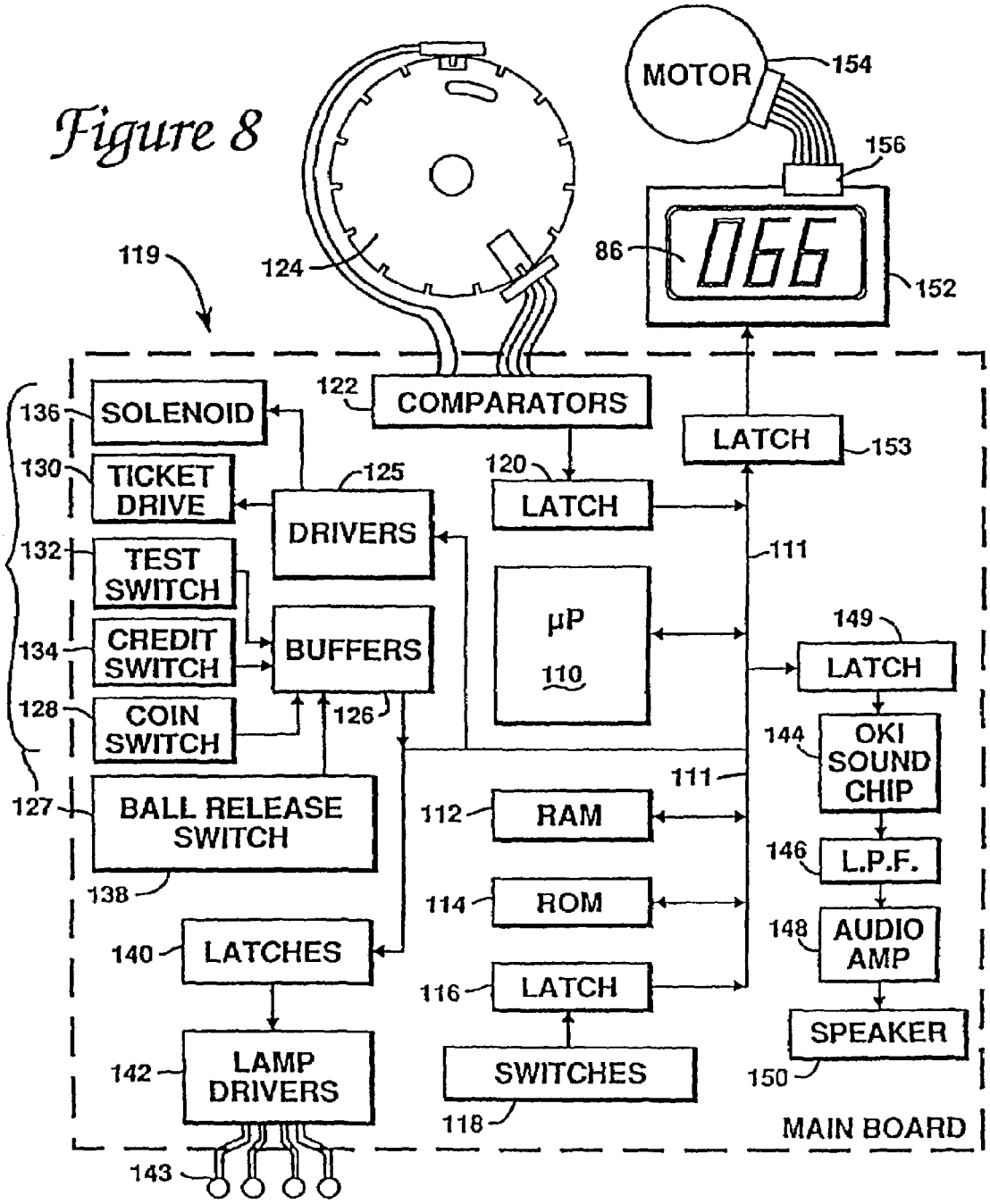

GAME APPARATUS WITH ROTARY INDICATOR AND BONUS MULTIPLIER

BACKGROUND OF THE INVENTION

1. Field of the Invention

This invention relates to games normally played in an arcade environment, and more particularly to such games played by directing a playing piece towards a target and seeing the results of game play displayed on a rotatable wheel.

2. Background of the Related Art

Roll-down games have been played for many years in arcade environments. These games usually include a ramp and one or more targets at the end of the ramp. A player rolls a ball down the ramp towards a desired target, and a game score is displayed on a scoring display based upon the player's success.

In U.S. Pat. No. 810,299, O. E. Pettee describes a game in which a ball is rolled down a plane towards an upright target pin. When the pin is impacted, a motor activates to spin a dial. When the dial stops spinning, it indicates the player's score.

In U.S Pat. No. 2,141,580, S. E. White describes a game in which a ball is tossed into holes marked in various time intervals. A spinning dial hand is stopped from rotating by the amount of time indicated by the hole that the ball is tossed into. The object of the game is to make the dial stop at a chosen character or numeral on the dial face.

In U.S. Pat. No. 2,926,915, F. D. Johns describes a skee-ball game in which a ball is rolled towards a scoring drum and in which tickets are dispensed to the player by an electrically operated automatic ticket dispenser.

Roll-down games of the prior art, while enjoyable, are rather simple games and, as such, often lead to rapid player boredom. This is undesirable in an arcade environment where revenues are directly related to the continuous, repeated use of the games.

SUMMARY OF INVENTION

The present invention provides an apparatus and method or progressively scoring contributions from multiple individual game units, and also provides an apparatus and method for an individual roll-down game including a spinning wheel. These improvements add excitement and complexity to the game, which tends to prolong player involvement.

The multi-station game apparatus includes two or more individual units of a game of skill connected to a progressive scoring apparatus. As players operate individual game units, the units contribute numerically to a progressive display. Each individual game unit has the ability to dispense a non-monetary award, such as tickets, baseball cards, etc., to a player based on the score achieved by that player. When a player of a game unit accomplishes a predetermined task on an individual game unit, he or she receives a non-monetary award based upon the progressive score. This bonus award adds excitement to the game.

A roll-down game unit of the present invention includes a ramp, targets at the end of the ramp, and a wheel associated with the targets. Preferably, the targets are apertures provided near the end of the ramp. If a ball is rolled down the ramp into a certain aperture, that aperture might be predetermined to rotate the wheel a certain distance clockwise. A different aperture might be predetermined to rotate the wheel a specific distance counterclockwise, or not rotate the wheel at all.

The score of the game is based upon the wheel's position. If the wheel is rotated and stops at a number displayed on the wheel, the score might increase by that number. The wheel might display a "Bankrupt" position, which would reduce the score to zero. A further variation of the game would include an award dispenser, which would dispense a non-monetary award based upon the final score once the game was over.

The wheel adds complexity and interest to an otherwise simple roll-down game. This again increases player involvement with the game and increases the revenue produced by the game.

These and other advantages of the present invention will become apparent to those skilled in the art after reading the following descriptions and studying the various figures of the drawings.

BRIEF DESCRIPTION OF THE DRAWINGS

FIG. 7 is a block diagram of the control system for an individual game unit;

FIG. 8 is a block diagram of the electronic components used in an individual game unit;

DETAILED DESCRIPTION OF THE PREFERRED EMBODIMENTS

Figure 1:
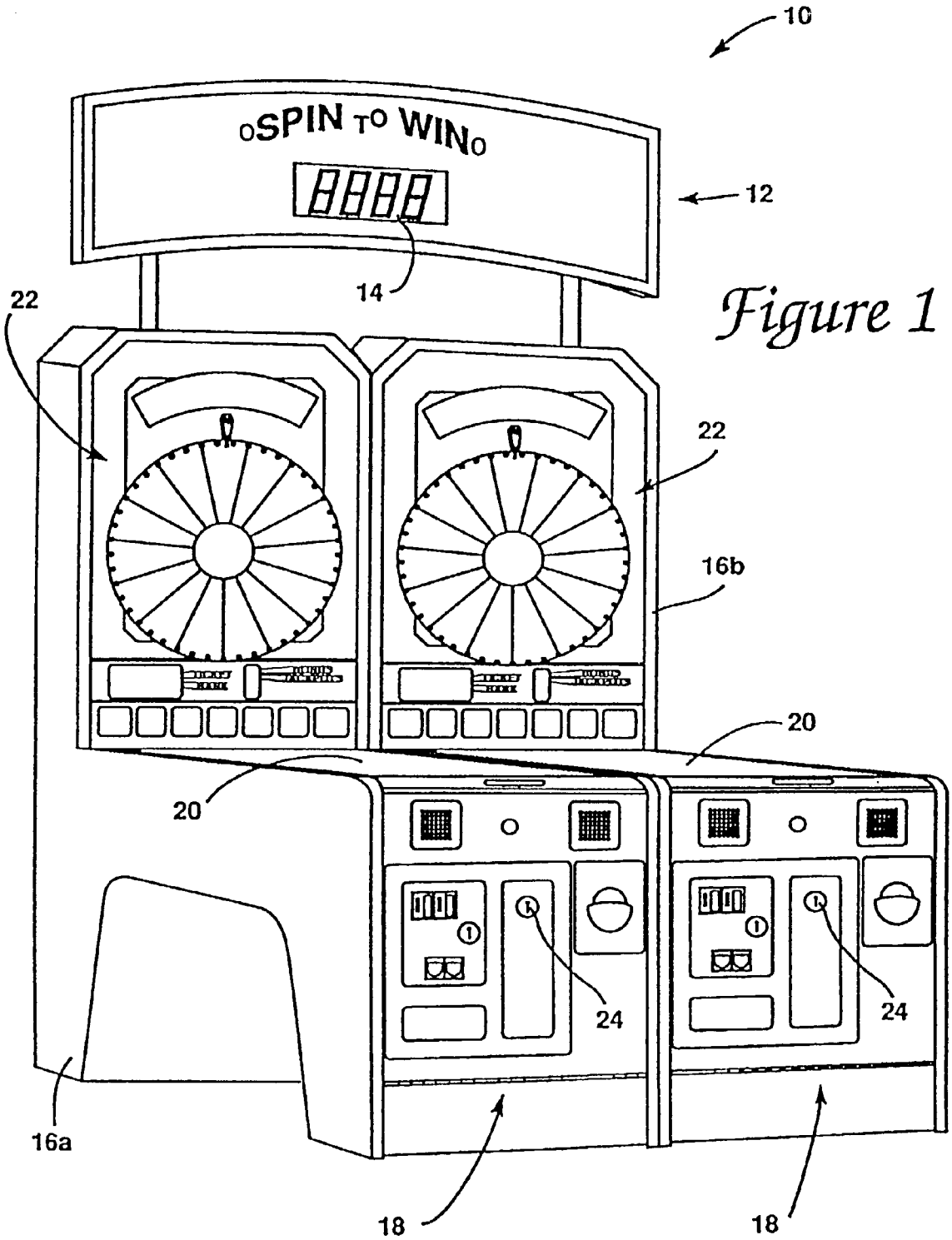
FIG. 1 is a perspective view of two individual game units connected to a progressive score display.

In FIG. 1, a multi-station game apparatus 10 in accordance with the present invention includes a progressive bonus apparatus 12 with progressive score display 14 coupled to a first individual game unit 16*a* and a second individual game unit 16*b*. Further individual game units 16 may be coupled to the progressive game apparatus 10 as desired.

Each individual game unit 16 has the ability to be played on its own, independent of the other game units 16 coupled to progressive bonus apparatus 12. Each individual game unit 16 includes a front panel 18 and a display area 22. A goal for each game unit 16 should be accomplished in a skillful manner; for instance, a ball can be guided into an aperture using hand-eye coordination, or a disc or ball could be skillfully aimed into a target using electrical controls.

An individual game unit 16 further has the ability to dispense a non-monetary award to a player. Such an award might be tickets redeemable for prizes. The award also could be baseball cards or other similar non-monetary prizes. In the preferred embodiment, each individual game unit 16 dispenses one or more tickets to the player from the front panel 18 through an award dispensing slot 24. Ticket dispensing mechanisms are well-known in the prior art.

Figure 2:
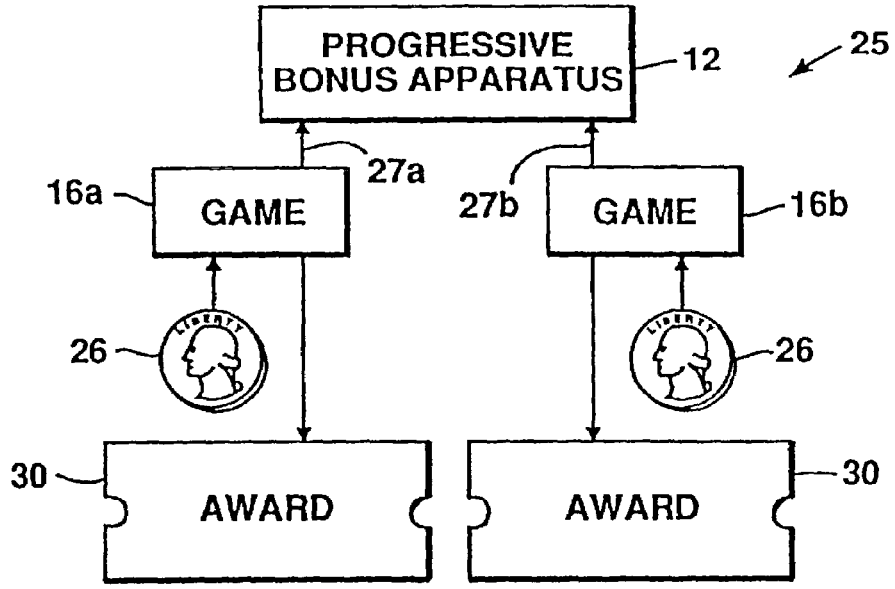
FIG. 2 is a flow chart of the progressive enhanced award process.

The process that the multi-station game apparatus 10 uses to receive money and dispense non-monetary awards is illustrated in the block diagram 25 of FIG. 2. A player inserts monetary input 26 into an individual game unit 16*a* or 16*b*. Typically, this monetary input 26 is one or more coins, or it may be tokens that are standard in an arcade environment. Each game unit 16*a* and 16*b* is connected to the progressive bonus apparatus 12 by a data bus 27*a* and 27*b*, respectively.

The progressive bonus apparatus 12 has an output on a progressive score display 14 (see FIG. 1) which begins at a predetermined starting value. For example, the progressive score might be set at a starting score of zero. Or, so that a bonus award might be immediately available to players, the starting score could be set at a higher value.

The progressive score displayed by the progressive bonus apparatus 12 is accumulated from contributions by the individual game units 16 over the data busses 27*a* and 27*b*. The contributions can be determined in a variety of ways. In the preferred embodiment, each game unit 16 sends a signal to the progressive bonus apparatus 12 whenever a player deposits a coin or coins into the game unit 16. When the progressive bonus apparatus 12 receives this signal, it increments the progressive score by one, one-half, or another predetermined value. Thus, each game unit 16 that is played will increment the progressive score by this value. Other methods might be used where the game unit 16 sends its increment signal when a player reached a predetermined score. Also, the progressive bonus apparatus 12 could be set to multiply the progressive score by a selected quantity whenever a game unit 16 sends an increment signal.

Each individual game unit 16 has one or more predetermined tasks for the player to accomplish in order for the player to receive a bonus award 30 based on the progressive score displayed by the progressive bonus apparatus 12. All game units 16 that are attached to a single progressive bonus apparatus 12 should require the same predetermined task, so that each player competing for the progressive score has a task of the same duration and level of difficulty. This predetermined task has several possible variations. One variation might be that the player has to achieve a specific game score on his individual game unit 16 in order to win the progressive score. A different variation might be that the player must finish two or more games in a row by accomplishing a specific game result, such as hitting a "jackpot" on the game display 22.

The first player to accomplish the predetermined task is entitled to the non-monetary bonus award 30 based upon the progressive score displayed on the progressive bonus apparatus 12. In the preferred embodiment, this bonus award 30 is manually given to the winning player by the owner or operator of the multi-station game apparatus 10. The bonus award 30 can be a number of normal game unit 16 awards: tickets, cards, or whatever the non-monetary award might be. Such a bonus award 30 might also be dispensed to a player as follows: the progressive bonus apparatus 12 sends the progressive score data over a data bus to the winning game unit 16. The winning game unit 16 then dispenses the bonus award 30 to the player by that game unit's 16 normal award-dispensing means 24. In any case, once the player has won the bonus award 30, his individual game unit 16 is reset and the progressive bonus apparatus 12 is reset.

Figure 3:
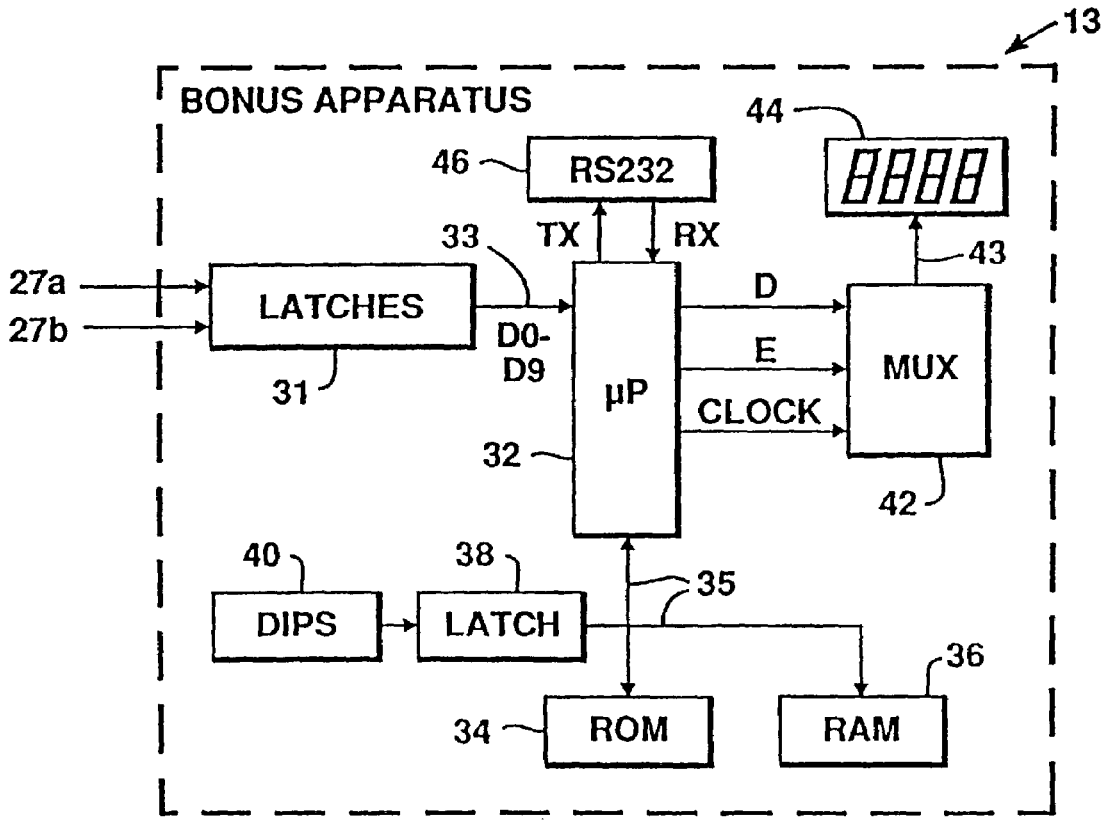
FIG. 3 is a block diagram of the microprocessor and display electronics used in the progressive bonus apparatus.

FIG. 3 is a block diagram of a control system 13 for the progressive bonus apparatus 12. The control system 13 includes a microprocessor 32, data bus 33, read-only memory (ROM) 34, random-access memory (RAM) 36, a latch 38, DIP switches 40, a multiplexer 42, an LED display 44, and an RS-232 port 46.

The microprocessor 32 is preferably an Intel 8031 8-bit microprocessor, which has the range of features adequate for the task, including eight data lines and sixteen address lines. The microprocessor 32 receives data inputs D0–D9 inputs on data bus 33 from individual game units that are connected to the progressive bonus apparatus 12; one data line is required per game unit, so a maximum of ten individual games may be connected to the progressive bonus apparatus in this embodiment. Data latches 31 are used to couple the data busses from each unit (such as data busses 27*a* and 27*b*) to the data bus 33.

The microprocessor 32 is coupled to ROM 34 by an address/control/data bus 35. The ROM 34 is preferably an erasable programmable read-only memory (EPROM) that contains the start-up instructions and operating system for the progressive bonus apparatus. Microprocessor 32 is connected to RAM 36 by the bus 35 to permit the use of RAM as scratch-pad memory.

The microprocessor 32 is also coupled to a latch 38 and DIP switches 40 by bus 35. The DIP switches 40 provide selectable functions that the owner or operator of the multi-unit game apparatus 10 may change to his or her liking. These selectable functions include setting the base payout score that the progressive bonus apparatus 12 will display in its starting state, and the increment value that the apparatus will use to increase the progressive score whenever a player achieves the predetermined task. Other selectable functions could also be set by the DIP switches depending on how many selectable game options and features are desired.

The microprocessor 32 is also coupled to a multiplexer 42. The multiplexer 42 receives a clock signal, an enable signal, and a serial LED data signal from the microprocessor 32. The multiplexer then outputs control signals to the segments of the LED display 44 on a bus 43.

The progressive bonus apparatus can also optionally send and receive message signals through a standard RS-232 interface 46. The RS-232 interface allows the control system 13 to be coupled to a computer system or other data processing system to allow the control and analysis of the control system 13.

The control system 13 for the progressive bonus apparatus 12 operates as follows. The microprocessor 32 first reads the low memory from ROM 34 over bus 35 and then sequences through the software instructions stored in ROM. The software from the ROM 34 instructs the microprocessor 32 to read the DIP switches 40, read in the game unit signals on busses 27*a* and 27*b* from the latches 31, and display or update the score LED display 44 with the information from the game unit signals. If a game unit signal on busses 27*a* or 27*b* indicates a game is over, the microprocessor 32 modifies the progressive score by the determined amount. When a game unit signal on busses 27*a* or 27*b* indicates that a game unit 16 has won the progressive bonus award, the microprocessor 32 sends signals to flash the score display and activate lights and sound speakers (not shown) indicating the bonus has been won. The owner or operator of the game units 16 may then present the bonus award to the player who won it. In an alternate embodiment, the microprocessor 32 in progressive bonus apparatus 12 sends the progressive score total to the winning individual game unit 16 over a data bus, and the individual game unit 16 can then dispense the bonus award to the player.

Figure 4:
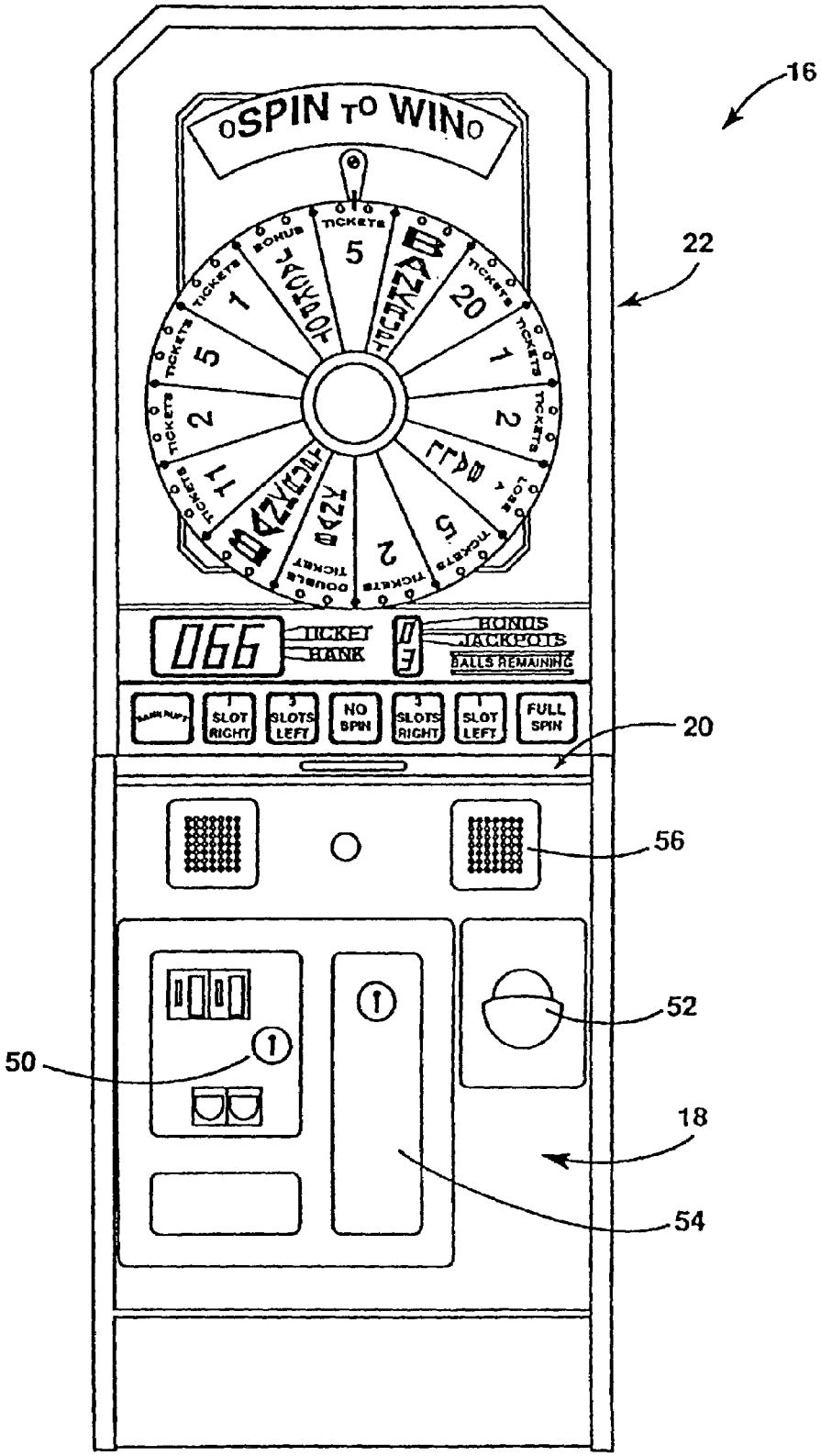
FIG. 4 is a front view of an individual game unit.

FIG. 4 is a front view of the preferred embodiment of an individual game unit. The game unit 16 comprises the front panel section 18, a playing surface 20, and the display section 22.

The front panel section comprises a coin deposit slot 50, a ball dispenser 52, a ticket dispenser 54, and a speaker 56. The coin deposit slot 50 may accept standard currency coins or game tokens that are normally available in an arcade environment, and also includes a coin return button and coin return slot. Coin boxes suitable for use in game unit 16 are readily available on the commercial market.

The ball dispenser 52 provides a ball for the player's use. In the preferred embodiment, the balls are rolled by the player down an inclined playing surface 20. Other types of playing pieces can also be used and directed down the playing surface, such as discs, cylinders, or other objects.

Figure 5:
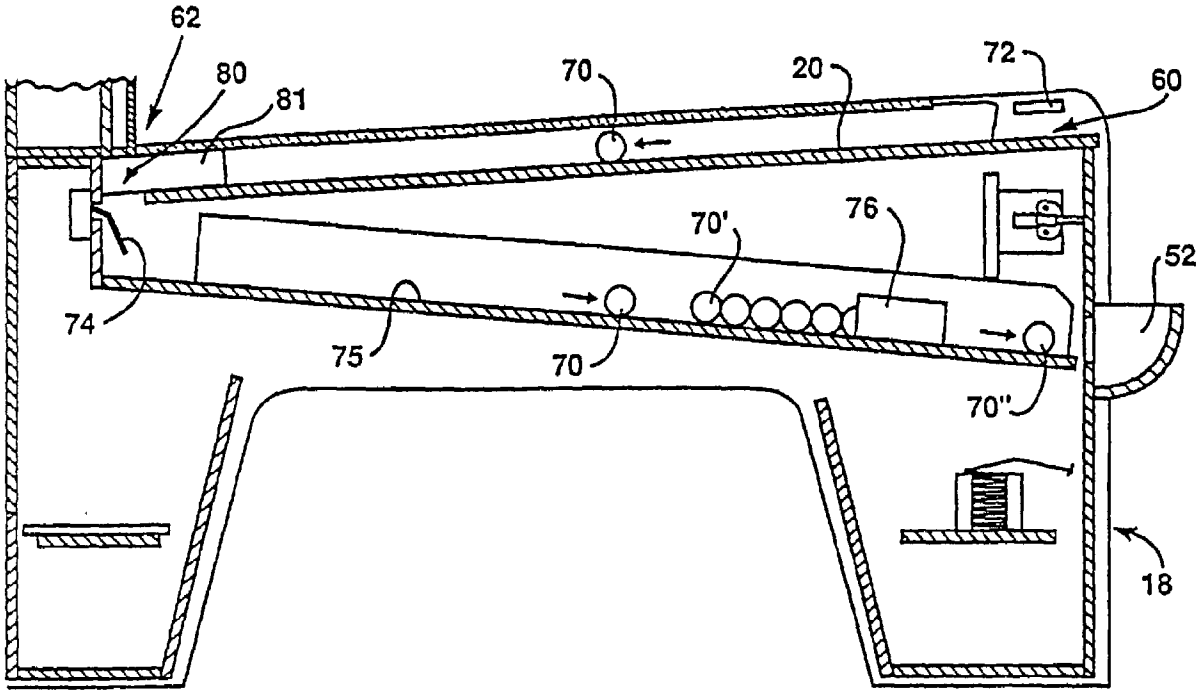
FIG. 5 is a side cross-section of the playing surface and playing piece return mechanism of an individual game unit.

The balls are dispensed to the player as shown in FIG. 5. The ball 70 is picked up by a player from the playing piece dispenser 52 and rolled down the playing surface 20 and through an opening 72 in the playing surface 20. The ball 70 then rolls down a ramp 75 to join other balls 70' which are held in a holding area 76. A solenoid within the holding area 76 ejects a ball 70" to roll into the playing piece dispenser 52, to be used by the player in the same way as the previous ball 70.

Referring again to FIG. 4, the ticket dispenser 54 dispenses a ticket award to the player based on the game score when the player has played all of the allotted balls 70 (typically 3–5 balls). Other awards may be chosen by the game owner; possibilities include tickets that, when saved to some predetermined amount, are worth various prizes; or baseball or other sports cards could also be dispensed. The non-monetary award is stored in a storage area behind the front panel 18.

The speaker 56 emits sounds based on game actions and other game states and is controlled by the game unit controller system. The operation of the speaker will be discussed in greater detail subsequently.

Figure 6A:
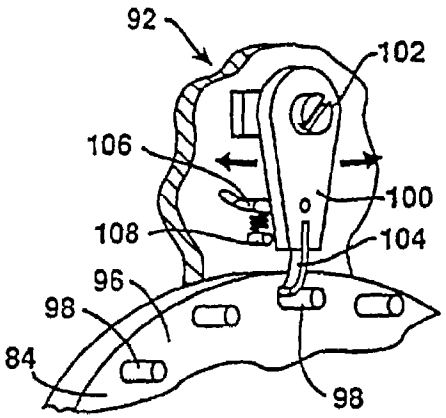
FIG. 6*a* is a detail view of the wheel scoring indicator.
Figure 6:
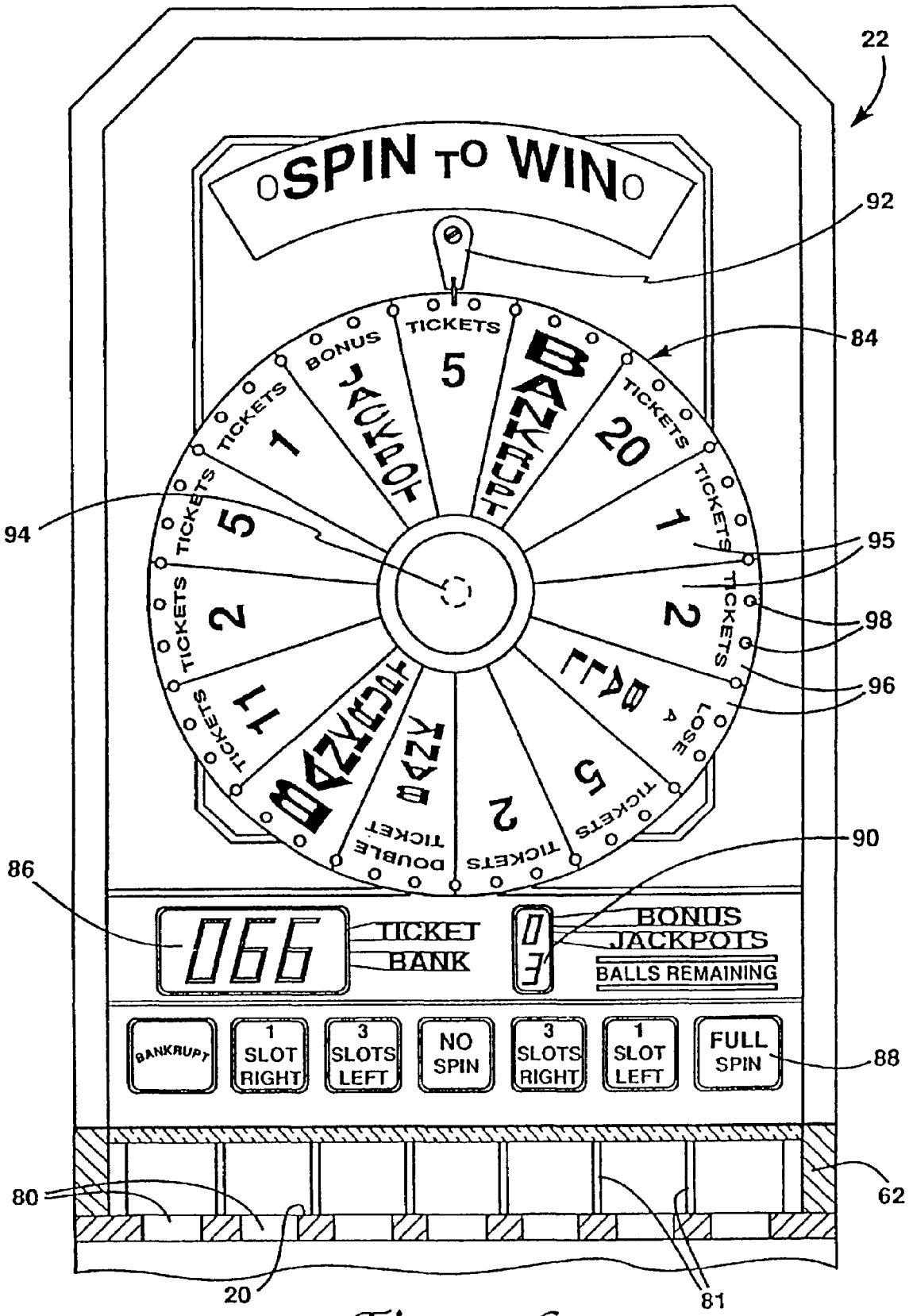
FIG. 6 is a detail view of the wheel, display, and target apertures of an individual game unit.

The playing surface 20 is shown in FIGS. 1, 5, and 6. It includes a player end 60 and a target end 62. Preferably, the surface 20 comprises a ramp where the target end 62 is lower than the player end 60. The player end 60 may include an opening 72 through which the player can drop the playing piece 70 onto the playing surface 20. The playing surface 20 is preferably a smooth, unobstructed surface; but it can also be provided with obstacles. The target end 62 includes a plurality of targets 80 that are receptive to the playing piece. In the preferred embodiment, the targets 80 are apertures, holes or slots that are associated with a switch 74 such that when the ball falls through a slot 80, the associated switch 74 is activated. Each slot 80 is defined by slot guide walls 81, which guide the ball into a particular target slot 80 to activate a switch 74. The guide walls 81 extend a short distance from the target end 62 onto the playing surface 20.

The display section 22 is shown in greater detail in FIG. 6. The display section 22 includes a wheel 84, a game score display 86, target displays 88, ball count display 90, and a pointer mechanism 92. This view also shows the target end 62 of the playing surface 20 as well as the targets 80. The wheel 84 is a flat circular disk that rotates on an axle 94. The wheel 84 is divided up into a number of segments 95, where each wheel segment 95 influences a specific game result, such as game score. Each wheel segment 95 is further divided into three sections 96 by section markers 98. These section markers 98 are short posts extending perpendicularly from the front surface of wheel 84 and engage pointer mechanism 92 as the wheel spins.

The game score display 86 is an LED display that indicates current game score to the player. Target displays 88 indicate the value or function of each individual target slot 80 to the player when a ball 70 is received by that target slot 80.

The ball count display 90 shows the status of playing pieces allotted to the player. In the preferred embodiment, this display 90 shows the number of balls remaining for the player to use in the game.

The pointer mechanism 92 is further illustrated in FIG. 6*a*. In this figure, the pointer mechanism 92 consists of a base 100, an axle 102, a flexible pointer 104, and a detection mechanism 106. The flexible pointer 104 is made of a flexible rubber material and slows down the spinning wheel 84 by engaging each section marker 98 as the wheel 84 rotates. The base 100 pivots on the axle 102 to one side of a center post 108 every time a section marker 98 engages the flexible pointer 104. When the wheel 84 eventually stops rotating, the flexible pointer 104 is preferably pointing to a single section 96 between two section markers 98. At times it may occur that the flexible pointer 104 is pressed against a section marker 98 when the wheel 84 stops rotating; in this case, it is ambiguous at to which section 96 the pointing mechanism 92 is pointing. To prevent this result, a detection mechanism 106 will detect whenever the base 100 is not substantially vertical by detecting if the base 100 is pivoted to one side or the other and, if so, the direction of the pivot. If the base 100 is pivoted, the pointing mechanism 92 is assumed to be engaged with a section marker 98, so the microprocessor 110 directs a motor (described below) to rotate the wheel 84 slightly, in the opposite direction to the pivot, enough steps so that the pointing mechanism 92 disengages from the section marker 98.

FIG. 7 is a block diagram illustrating a preferred electrical system of a game unit 16. The system includes a power source 155, an LED printed circuit board (PCB) 152, a main PCB 157, and illumination lamps 158. The power source 155, in the preferred embodiment, is a commercially available 110 V AC power supply. The LED PCB 152 contains the main game score display 86 as well as the drivers for the motor that rotates the wheel 84. The main PCB 157 contains the major circuit components of the game unit 16, including the microprocessor, drivers/buffers, amplifiers, and DIP switches (described in FIG. 8). Finally, the illumination lamps 158 illuminate indicators and other parts of the game unit.

FIG. 8 is a block diagram of a control system 119 on main board 157. The components include a microprocessor 110, RAM 112, ROM 114, a latch 116, DIP switches 118, latch 120, comparators 122, drivers 125, buffers 126, output switches 127, latches 140, lamp drivers 142, sound chip 144, low pass filter 146, audio amplifier 148, and speaker 150.

The control system 119 is coupled to position detection mechanism 124, lamps 143, game score display board 152, and a motor 154.

The microprocessor 110 is preferably an Intel 8031 8-bit microprocessor, which has the range of features adequate for the task, including eight data lines and sixteen address lines. The microprocessor 110 is coupled to ROM 114 by a data/address/control bus 111. The ROM 114 is preferably an erasable, programmable read-only memory (EPROM) that contains the start-up instructions and operating system for the microprocessor 110. Microprocessor 110 is connected to RAM 112 by bus 111 to permit the use of RAM for scratch-pad memory. Methods for coupling ROM 114 and RAM 112 to the microprocessor 110 by bus 111 including enable, address, and control lines are well-known to those skilled in the art.

The microprocessor 110 is also coupled to a latch 116 and switches 118 by the bus 111. The switches 118 provide selectable functions that the owner of the game unit may change to his or her liking. These selectable functions include the values of the targets in terms of score, sound effects, progressive jackpot value (if present), the amount of any award given, the test mode, the type of game, and so on. Other selectable functions could also be set by the switches depending on how many selectable game options and features are desired. The switches 118 also include, in the present embodiment, the switches 74 that are activated when a playing piece 70 rolls into a target slot 80 on the playing surface 20.

The microprocessor 110 is also coupled to another latch 120, which is similar to the latch 116 that connects the switches 118 to the microprocessor 110. The latch 120 receives data from the comparators 122, which are set up in op amp configurations using an LM393 or similar device. These comparators 122 receive data from the position detection mechanism 124 indicating the position of the wheel 84, and output that data to the latch 120 and the microprocessor 110. The position detection mechanism 124 is discussed in greater detail below; see FIG. 9. The comparators 122 also receive a signal from the pointing mechanism 92 indicating if it is sitting on a section marker 98 or not, and sends that data to the latch 120 and microprocessor 110.

The microprocessor 110 is also coupled to the drivers 125 and the buffers 126. The buffers 126 receive data from many of the switches 127, including the coin switch 128, which detects if a coin has been inserted into the game unit 16; the test switch 132, which activates a test mode for the game unit 16; the credit switch 134, which, when pushed by a player, starts a game; and the ball release switch 138, which indicates to the microprocessor 110 if a playing piece 70 has actually been dispensed to the player. The drivers 125 activate the remaining switches 127, including the ticket drive 130, which activates the dispensing of the non-monetary award (in this case, tickets) out of the non-monetary award dispenser 54; and the solenoid 136, which pushes a ball 70 into the ball dispenser 52.

The microprocessor 110 is also coupled to the latches 140 which latch data for the lamp drivers 142. The lamp drivers 142 supply power to the lamps 143, which include the lights on the display section 22 of the game unit 16 that are not part of the game score display 86 or other numeric displays.

The microprocessor 110 is also coupled to a sound chip 148. This chip is an OKI Voice Synthesis LSI chip that has eight data input lines coupled to the microprocessor 110 by a latch 149. The sound chip 144 receives its data from ROMs (not shown) and outputs sound data to a low pass filter 146, an audio power amplifier 148, and finally to the output speaker 150, which generates sounds to the player playing the game unit 16.

The microprocessor 110 is also coupled to a separate printed circuit board 152 containing the game score display 86 and the motor controller 156, which controls the motor 154. The bus 111 connecting the microprocessor to the display board 152 are latched by a latch 153. Four of the ten connecting lines go to the game score display 86, which consists of 7-segment LED digit displays. The remaining lines control the motor controller 156. Motor 154 is preferably a stepper motor coupled to a stepper motor controller, as is well-known to those skilled in the art.

The control system 119 operates briefly as follows. The microprocessor 110 first reads the low memory from ROM 114 over bus 111 and sequences through the software instructions stored in ROM. The settings of DIP switches in the switches block 118 are also read into the microprocessor. The software from the ROM 114 then instructs the microprocessor 110 to send and receive data over the bus 111 in order to conduct a game. For example, when the coin switch 128 is activated, indicating a coin has been inserted into the game unit, the microprocessor reads a signal from the buffers 126 from bus 111. The microprocessor then sends a signal to the drivers 125 to activate solenoid 136 in order to dispense a ball 70 to the player. The ball release switch 127 sends a signal through the buffers 126 to the microprocessor, indicating that a ball has been dispensed. The microprocessor then awaits a signal from switches 118 that indicate which switch 74 in target slot 80 the ball 70 activated. The specific switch 118 signal determines what data the microprocessor will send to the motor 154 in order to rotate the wheel 84 a specific amount (see FIG. 9 for a detailed description of the motor and wheel rotation). The microprocessor then reads data from latch 120 which contains data from comparators 122 indicating which segment 95 the pointing mechanism 92 is pointing to. From this data the microprocessor can modify the game score by a specific amount and display the new score by sending a signal to game score display board 152. The microprocessor then dispenses another ball 70 and repeats the game process until all balls have been dispensed. During game play, the microprocessor sends appropriate output signals over bus 111 to activate speaker 150 and lamps 143 whenever game action occurs.

Figure 9:
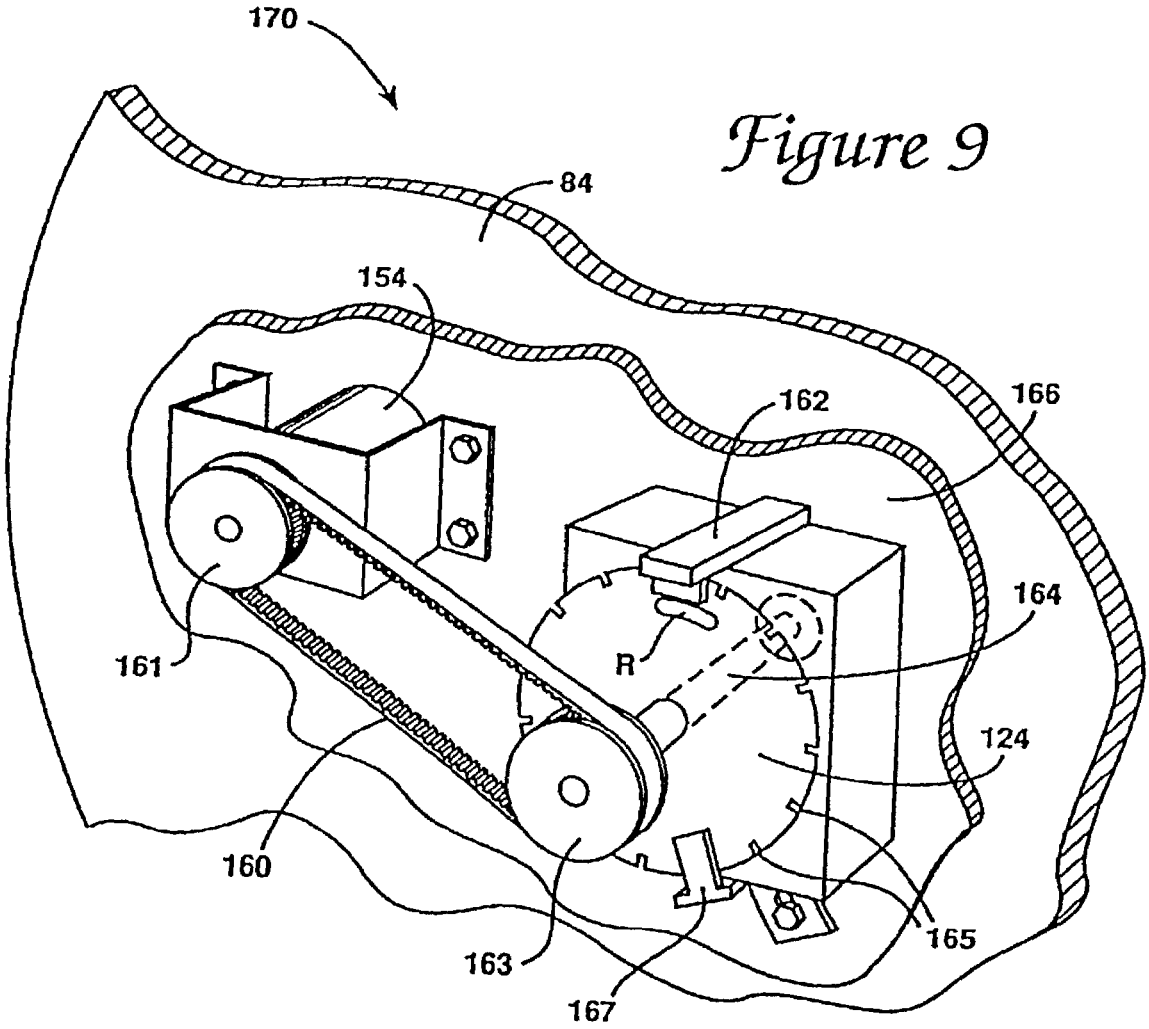
FIG. 9 is a perspective view of the wheel driving mechanism of an individual game unit including a preferred wheel position detector.

FIG. 9 shows the mechanism 170 to spin the wheel 84 and to detect its rotational position. Mechanism 170 is located on the backside 166 of the display section 22, behind wheel 84. The motor 154 is driven by a motor controller 156 on the game score display board 152. Axle 164 supports the wheel 84 for rotation. Motor 154 is connected to and rotates axle 164 by a toothed drive belt 160 and toothed pulleys 161 and 163 coupled to the shaft of motor 154 and to axle 164, respectively. Position detection wheel 124 contains notches 165 that correspond to the segments 95 on the wheel 84. The notches 165 are detected by optical detector 162 by sending a beam of light through a notch 165. If a notch 165 is aligned with the optical detector 162, pointer 104 is aligned with a segment 95.

The number of notches 165 that have passed through optical detector 162 as the position detection wheel 124 rotates can be counted by the microprocessor 110. If the original starting segment 95 of the wheel 84 was known, then the end segment 95 displayed on the wheel 84 can be deduced by counting the number of notches 165 that have passed through the optical detector 162. In this way, the microprocessor 110 knows what end segment 95 the pointing mechanism 92 is pointing to and knows how to affect the game score appropriately.

A wide reference notch R can provide an absolute position indication for the wheel 84. Wide notch detector 167 is an optical detector similar in design and function to detector 162; when the wide notch R is detected, a specific segment 95 on the wheel 84 is known to have rotated by pointing mechanism 92.

Figure 10:
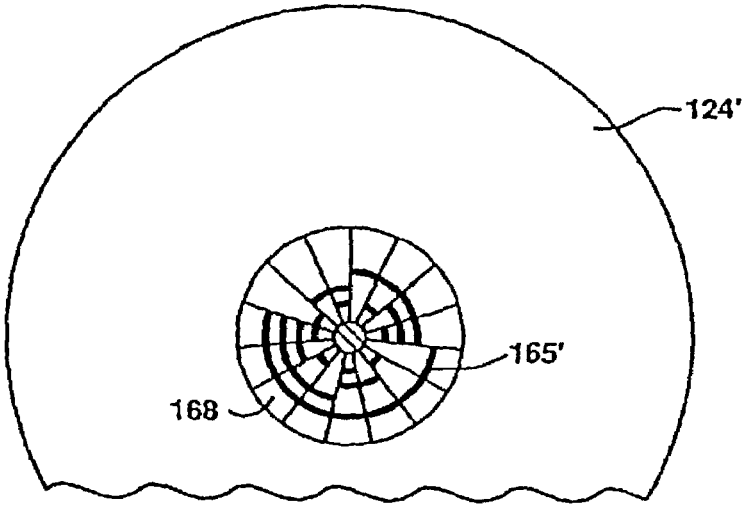
FIG. 10 is an alternate embodiment of a wheel position detector.

An alternate embodiment for wheel position detection is shown in FIG. 10. The position detection wheel 124' is not notched, but instead has optical bar code segments 165' that encode the segment positions 168 that correspond to the segments 95 on the front of the wheel 84. Specific segment 95 information is encoded in the segments 165' so that a wheel position may be known by reading the optical bar code segments 165' directly.

Figure 11:
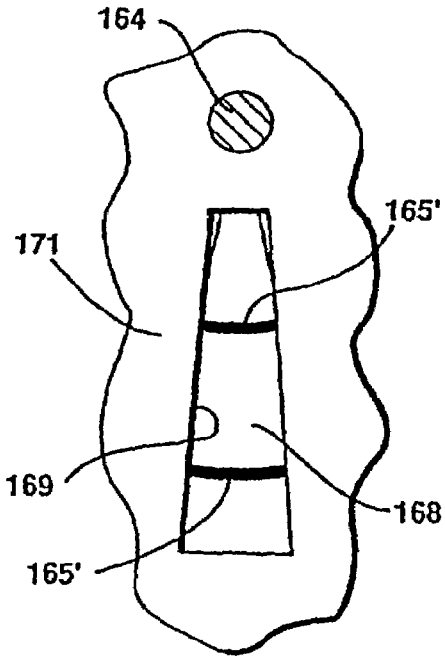
FIG. 11 is a detail view of the alternate wheel position detector of FIG. 10.

FIG. 11 shows a detail view of bar code segment 168 with optical bar code segments 165' being displayed through a slot 169 in a cover 171. The cover 171 serves to display only one bar code segment 168 width at a time.

Figure 12:
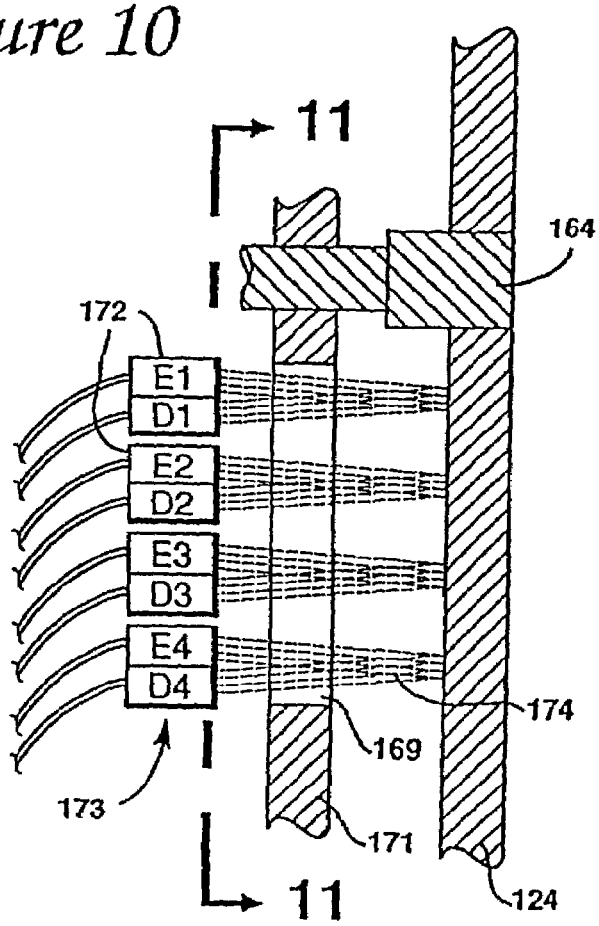
FIG. 12 is a cross sectional view of a reading mechanism for the alternate wheel position detector of FIGS. 10 and 11.

FIG. 12 shows a cross sectional of the wheel axle 164, position detection wheel 124', cover 171, and bar code reader 173. The bar code reader 170 consists of four emitter/detectors (E/D) 172. The emitter emits a beam of light 174 directed at the detection wheel 124'; and the amount of light reflected back to the detectors determines whether the light 174 had impinged upon a bar code. Once the number of bar code segments 165' is known, the number is decoded as a binary number and the segment 95 is known. Since there are four emitter/detectors 172, up to $2^4-1=15$ positions can be encoded in this preferred embodiment, assuming that an all-blank bar code segment 168 is undesirable as being ambiguous.

The operation of the preferred embodiment of the gaming apparatus may be briefly described as follows: A player deposits a coin or token into coin slot 50 of game unit 16 to start the game. The wheel 84 is driven by the motor 154 to spin a random number of revolutions to begin a game. The pointing mechanism 92 keeps track of the end segment 95 at which the wheel 84 stops moving. A ball 70 is deposited to the player in ball dispenser 52. The player directs the ball 70 onto playing surface 20 at the player end 60 through an opening 72 in a cover protecting the playing surface 20. The ball 70 is rolled towards the target end 62 of the playing surface 20 towards the targets 80, which are slots for the ball 70 to roll into. The ball 70 rolls into a slot 80 marked, for example, "3 slots left". The ball 70 activates a switch 74 below the slot 80 as it drops down to rolling surface 75. The ball 70 then rolls down ramp 75 to join a plurality of other balls 70' that are stored in a storage area 76; a microprocessor 110 signal then activates the solenoid 136 to dispense another ball 70" to the player if he or she has any playing pieces remaining to be played in his or her game.

Meanwhile, the switch 74 corresponding to the "3 slots left" slot 80 sends a signal to the microprocessor 110 which calculates the direction and the number of segments 95 the wheel 84 must be moved. The motor 154 turns the wheel 84 three segments 95 clockwise. The game then modifies the score or alters game conditions based upon the result displayed by that end segment 95. For example, suppose the end segment 95 displayed "5 tickets". Five points would then be added to the game score, displayed on game score display 86. If the result "Bankrupt" were displayed, then the game score would be reset to zero.

One of the target slot designations might be "Full spin". This would mean that a fast spin with a random result would be imparted on the wheel 84 by the motor 154. In order to keep track of the segment 95 the wheel 84 stops at, the position detection wheel 124 and optical detector 162 keep track of the amount of segments 95 that have rotated by so that the end segment 95 is calculated by the microprocessor 110. Alternatively, in the described alternate embodiment, the resulting segment 95 is read directly from bar code segments 165'.

The player will keep playing in this manner until he or she has used up his or her allotted amount of playing pieces. Once this occurs, the ticket dispenser 54 dispenses an award in relation to the player's final game score. For example, if the final game score is 20, 20 tickets could be dispensed to the player.

Figure 13:
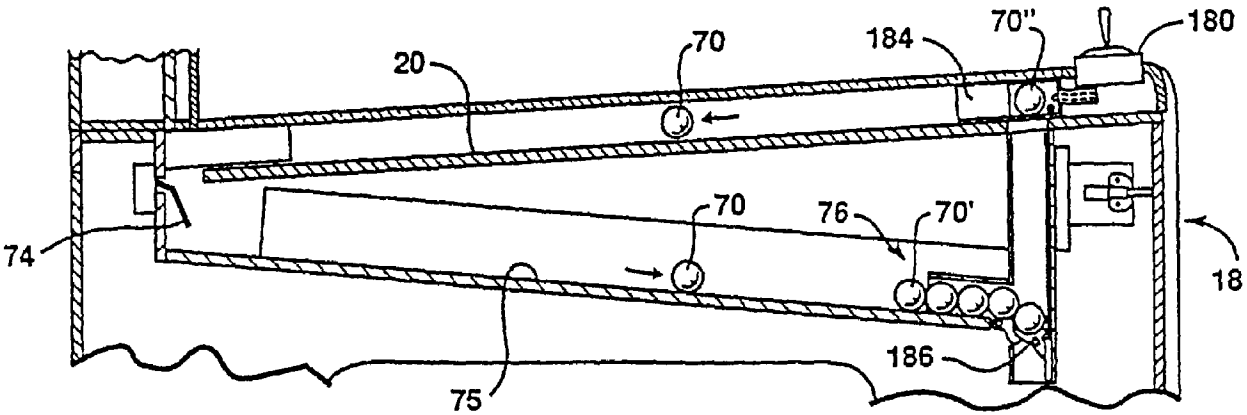
FIG. 13 is a cross-sectional view of the playing surface and playing piece return mechanism of an alternate embodiment of the present invention.

An alternate embodiment of the game unit is detailed in FIG. 13 in which there is no player contact with the ball 70. In this embodiment, the ball 70 is directed down the playing surface 20, its path being determined by controller 180, which might be a joystick controller as found on other arcade-type games. The controller 70 directs a guiding mechanism 184 left and right so that the player can decide to release the ball 70 when the guiding mechanism 184 is in position to release the ball 70 at a desired target. The ball 70 is directed down to the target end 62 and activates a switch 74 behind a specific target slot 80. The ball 70 then moves down ramp 75 to the holding area 76 where the other balls 70' are held, as in the previous embodiment. Meanwhile, switch 74 activates a rotating wheel and a score is determined; wheel mechanics and game score are achieved in a similar fashion to the embodiment described previously.

Figure 14:
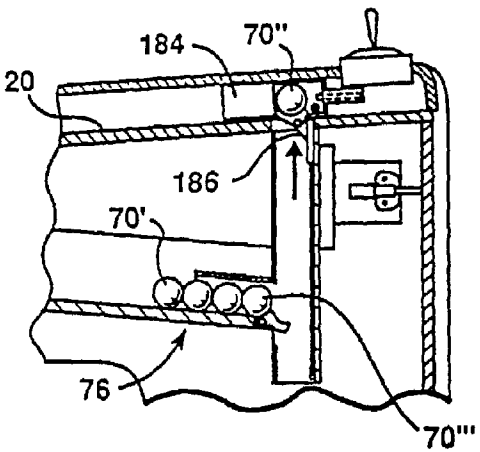
FIG. 14 is a detail view of the ball return mechanism of FIG. 13.

FIG. 14 illustrates the dispensing of a ball 70" to the guiding mechanism 184 in the alternate embodiment of FIG. 13. The ball 70" waits in holding area 76 on an elevator platform 186. When a previous ball 70 returns to holding area 76 and hits ball 70', elevator platform 186 moves upward by electrical motors, carrying ball 70". Elevator platform 186 stops moving when it is level with playing surface 20 and ball 70" is pushed through an opening in guiding mechanism 184 so that it rests in guiding mechanism 184. A player may now move and control the guiding mechanism 184 containing ball 70" using controller 180. Meanwhile, the elevator platform 186 moves down again to holding area 76 and the next ball 70'" moves onto it.

Figure 15:
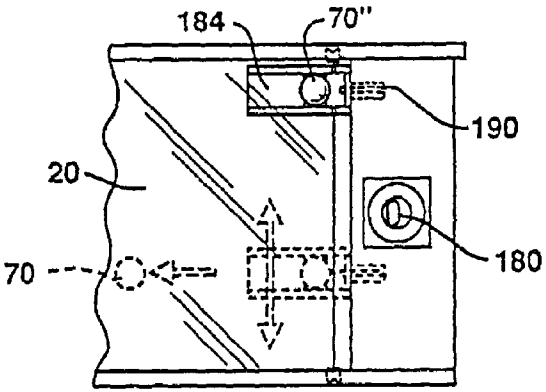
FIG. 15 is a partial top view of the playing surface of the alternate embodiment of FIG. 13.

FIG. 15 further illustrates the guiding mechanism 184. The guiding mechanism 184 is moved left and right as determined by controller 180. Controller 180 can control the guiding mechanism 184 by electrical signals and motors, or a mechanical system of gears, pulleys, etc. The guiding mechanism can also be controlled without a controller 180; for example, a player can move the guiding mechanism 184 manually by using a handle 190 attached to the guiding mechanism 184. The ball 70 is released from guiding mechanism 184 by activating a release control on the controller 180 when the guiding mechanism 184 is in the desired position. A solenoid or other electrical pushing mechanism can be used to eject the ball from the guiding mechanism, or an alternate method might be to use a mechanical release tab or spring to eject the ball 70 down the playing surface 20.

Figure 16:
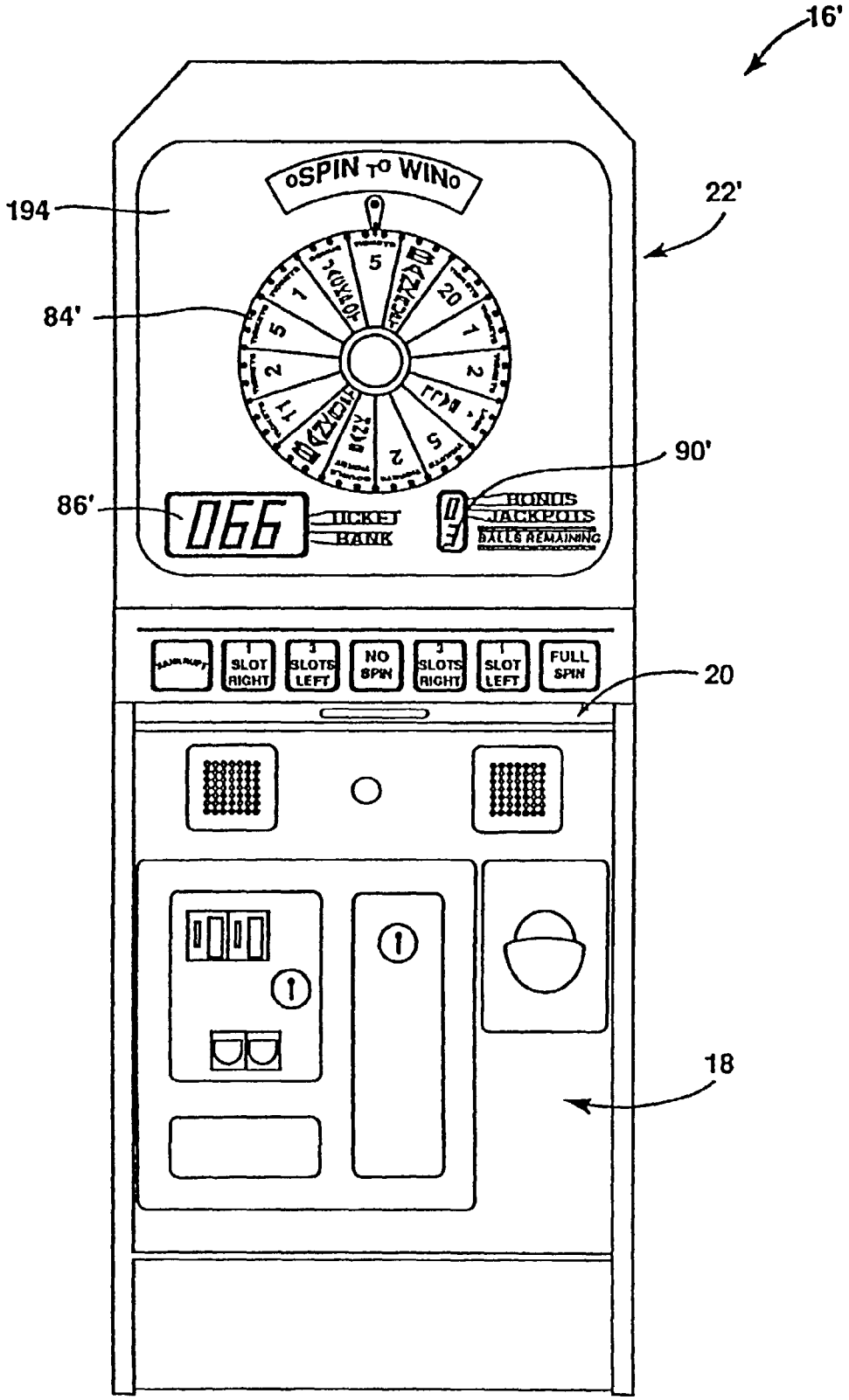
FIG. 16 is a front elevation view of an alternate embodiment of a game unit.

FIG. 16 shows a second alternate embodiment of the game unit 16. In this embodiment, game unit 16' includes a video screen 194 that preferably displays the same features of the display section 22 that were described in the initial embodiment of the application (see FIG. 6). Wheel 84', game score display 86' and ball count display 90' are graphical images on the video screen 194 and are controlled and updated completely by internal components (see FIG.

17). Each component of the display area 22' serves similar functions in game play as like areas did in the previous embodiments.

Figure 17:
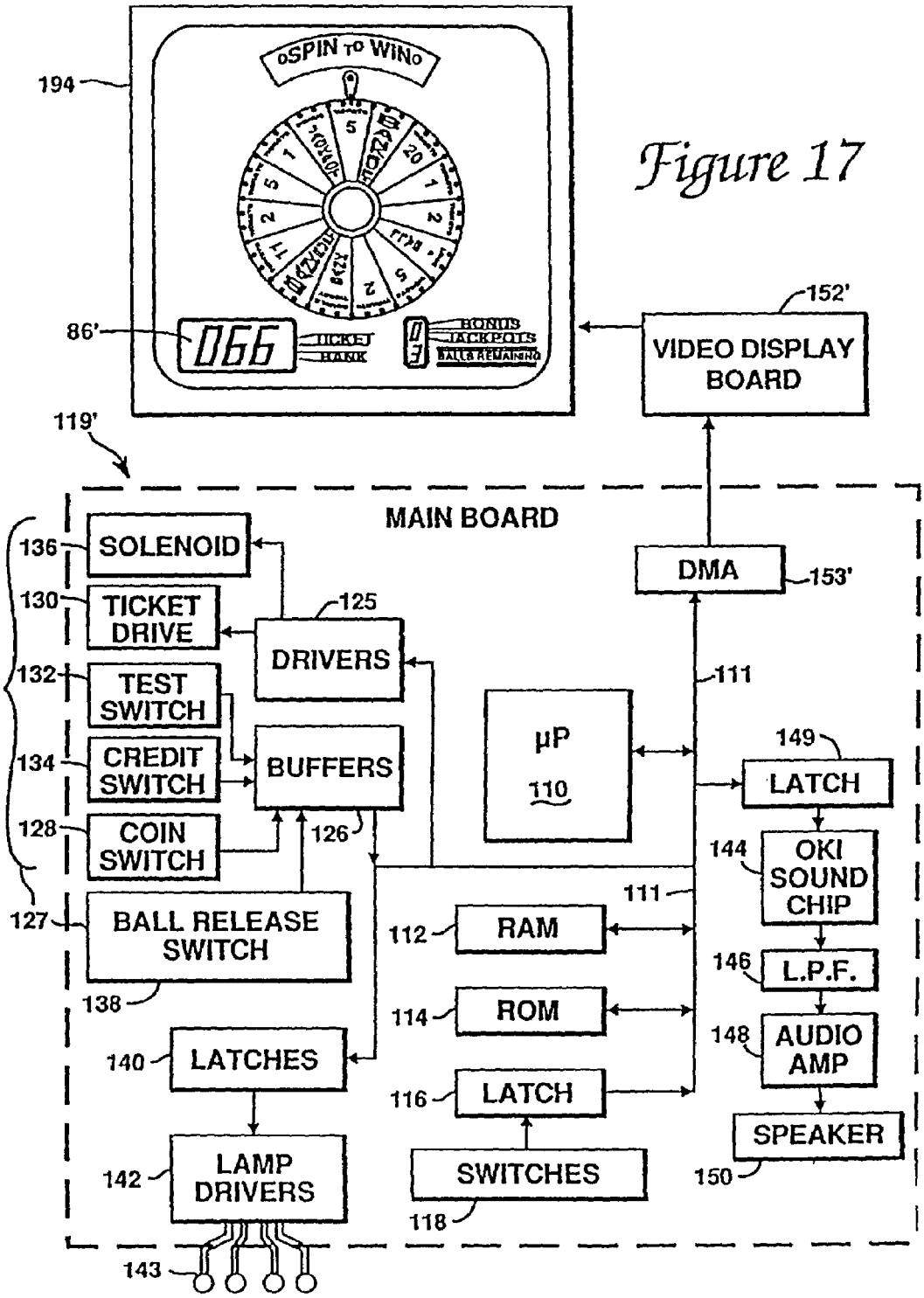
FIG. 17 is a block diagram of the electronic components used in the game unit of FIG. 16.

FIG. 17 is a block diagram of the control system 119' of the alternate embodiment of the game unit 16' shown in FIG. 16. The components of the control system 119' are similar to those described in the previous embodiment in FIG. 8, except for the components that relate to the game display 22'. Video display board 152' is coupled to direct memory access (DMA) 153', which is coupled to the microprocessor 110 and ROM 114 by bus 111. Video monitor 194 is coupled to a video display board 152'. The video display board 152' contains the control circuitry needed to create a graphical output on the video monitor 194 using control signals and data from the microprocessor 110. In this embodiment, microprocessor 110 is preferably a graphics-oriented microprocessor, so that the wheel and score images on the video monitor 194 have good resolution. The video images on video monitor 194 are moved and updated using software techniques well-known to those skilled in the art.

While this invention has been described in terms of several preferred embodiments, it is contemplated that alterations, modifications and permutations thereof will become apparent to those skilled in the art upon a reading of the specification and study of the drawings. For example, the playing surface 20 of the game unit 16 can be situated horizontally. The playing surface 20 can also be angled such that the target end 62 is higher than the player end 60.

It is therefore intended that the following claims include all such alterations, modifications and permutations as fall within the spirit and scope of the present invention.

What is claimed is:

1. A game apparatus with wheel-shaped bonus indicator comprising:

a game;

a wheel-shaped bonus indicator associated with said game, said wheel-shaped bonus indicator being supported for rotation around an axis and having a surface at least visually providing a plurality of segments;

a motor coupled to said wheel-shaped bonus indicator for selectively rotating said wheel-shaped bonus indicator; and an absolute position detector including a rotatable member coupled to said wheel-shaped bonus indicator for rotation therewith, said rotatable member having indices corresponding to said plurality of segments.

2. The game apparatus with wheel-shaped bonus indicator as recited in claim 1, wherein said indices include multiple notches on said rotatable member.

3. The game apparatus with wheel-shaped bonus indicator as recited in claim 2, further comprising an optical detector for detecting said multiple notches.

4. The game apparatus with wheel-shaped bonus indicator as recited in claim 1, wherein said indices include visually discernible indicia provided on a surface of said rotatable member.

5. The game apparatus with wheel-shaped bonus indicator as recited in claim 4, wherein said indicia include bar code segments for encoding segment position information corresponding to said plurality of segments of said wheel-shaped bonus indicator.

6. The game apparatus with wheel-shaped bonus indicator as recited in claim 5, further comprising a bar code reader for reading said bar code segments.

7. A game apparatus with wheel-shaped indicator comprising:

a wheel-shaped indicator, said wheel-shaped indicator being supported for rotation around an axis and having a surface at least visually providing a plurality of segments;

a motor coupled to said wheel-shaped indicator for selectively rotating said wheel-shaped indicator; and a position detector including an index member and an index member detector wherein one of said index member and said index member detector is coupled to said wheel-shaped indicator for rotation therewith, said index member having position indices corresponding to said plurality of segments.

8. The game apparatus with wheel-shaped indicator as recited in claim 7, wherein said position indices include multiple notches on said index member.

9. The game apparatus with wheel-shaped indicator as recited in claim 8, wherein said index member rotates with said wheel-shaped indicator and wherein said index member detector comprises an optical detector adapted for detecting said multiple notches.

10. The game apparatus with wheel-shaped indicator as recited in claim 9, wherein said optical detector includes a light source and a light detector.

11. The game apparatus with wheel-shaped indicator as recited in claim 7, wherein said position indices include indicia provided on a surface of said index member.

12. The game apparatus with wheel-shaped indicator as recited in claim 11, wherein said indicia include bar codes that encode segment position information corresponding to said plurality of segments of said wheel-shaped indicator.

13. The game apparatus with wheel-shaped indicator as recited in claim 12, further comprising a bar code reader for reading said bar codes.

14. A game apparatus with wheel-shaped indicator comprising:

a game having at least an element of chance;

a wheel-shaped indicator associated with said game, said wheel-shaped indicator being supported for rotation around an axis and having a surface at least visually providing a plurality of segments;

a motor coupled to said wheel-shaped indicator for selectively rotating said wheel-shaped indicator; and an optical position detector including a light-modulating member coupled to said wheel-shaped indicator for rotation therewith, said light-modulating member including a plurality of position indications corresponding to said plurality of segments.

15. The game apparatus with wheel-shaped indicator as recited in claim 14, wherein said light-modulating member blocks and transmits light.

16. The game apparatus with wheel-shaped indicator as recited in claim 14, wherein said plurality of position indications includes a plurality of apertures.

17. The game apparatus with wheel-shaped indicator as recited in claim 16, further comprising an optical detector that includes a light source and a light detector.

18. The game apparatus with wheel-shaped indicator as recited in claim 14, wherein said light-modulating member modulates light reflected from said light-modulating member.

19. The game apparatus with wheel-shaped indicator as recited in claim 18, wherein said plurality of position indications include indicia provided on a surface of said light-modulating member.

20. The game apparatus with wheel-shaped indicator as recited in claim 19, wherein said indicia include bar codes that encode position information corresponding to said plurality of segments of said wheel-shaped indicator.

21. The game apparatus with wheel-shaped indicator as recited in claim 20, further comprising a bar code reader for reading said bar codes.

22. The game apparatus with wheel-shaped indicator as recited in claim 14, further comprising a controller coupled to said motor and operative to stop a rotation of said wheel-shaped indicator at a predetermined segment.

23. The game apparatus with wheel-shaped indicator as recited in claim 22, wherein said controller causes said rotation of said wheel-shaped indicator to decelerate before coming to a stop at said predetermined segment.

24. The game apparatus with wheel-shaped indicator as recited in claim 14, wherein:

said wheel-shaped indicator comes to a pre-determined stopping position based on an action of a player; and an award is based in part on said pre-determined stopping position.

25. The game apparatus with wheel-shaped indicator as recited in claim 14, wherein said motor is a stepper motor.

26. The game apparatus with wheel-shaped indicator as recited in claim 14, wherein said motor is a servo motor.

27. A game apparatus with rotary indicator comprising:

a game including at least an element of chance and displaying a numeric value;

a rotary indicator associated with said game, said rotary indicator being supported for rotation around an axis and having a surface visually providing a plurality of segments, wherein said plurality of segments includes a bonus multiplier segment having indicia specifying an integral amount by which said numeric value, as displayed before said rotary indicator rotates, will be multiplied after said rotary indicator rotates and then stops, when said bonus multiplier segment is aligned with a pointer;

a motor for selectively rotating said rotary indicator; and a position detector separate from said motor for detecting which segment is aligned with said pointer.

28. A game apparatus with bonus indicator comprising:

a game including a game controller and a display for a numeric value;

a bonus indicator associated with said game, said bonus indicator being supported for rotation around an axis and having a surface providing a plurality of segments wherein at least one segment of said plurality of segments is a multiplier segment having indicia specifying an integral amount by which said numeric value will be multiplied, and wherein said game controller provides a multiple of said numeric value as an award when any one of said multiplier segments is indicated by said bonus indicator.

29. A game apparatus with wheel-shaped indicator comprising: a game displaying a numeric value;

a wheel-shaped indicator associated with said game, said wheel-shaped indicator being supported for rotation around an axis and having a surface providing a plurality of segments including at least one multiplier segment having indicia specifying an amount by which said numeric value will be multiplied when said game provides a bonus;

a motor coupled to said wheel-shaped indicator for selectively rotating said wheel-shaped indicator; and a position detection means for detecting positions corresponding to said plurality of segments of said wheel-shaped indicator.

30. An apparatus comprising:

a numerical display;

a body supported for rotation around an axis of rotation, said body being provided with a plurality of indicia including at least one multiplier indicia specifying an integral amount by which a number on said numerical display, which is present before a rotation of said body, will be multiplied, after said body rotates and stops;

a fixed pointer adapted to point to a selected indicia of said plurality of indicia; and a motor adapted to selectively rotate said body to align said pointer with said at least one multiplier indicia to indicate a multiplied award.

31. A game apparatus with wheel-shaped bonus indicator as recited in claim 1 wherein at least one of said plurality of segments is a multiplier segment.

32. A game apparatus with wheel-shaped indicator as recited in claim 7 wherein at least one of said plurality of segments is a multiplier segment.

33. A game apparatus with wheel-shaped indicator as recited in claim 14 wherein at least one of said plurality of segments is a multiplier segment.

34. A game apparatus with rotary indicator comprising:

a game having at least an element of chance;

a rotary indicator associated with said game, said rotary indicator being supported for rotation around an axis and having a surface visually providing a plurality of segments wherein said plurality of segments includes a bonus multiplier segment for multiplying an award provided by said game when aligned with a pointer;

a motor for selectively rotating said rotary indicator; and an optical position detector including a light-modulating member coupled to said wheel-shaped indicator for rotation therewith, said light-modulating member including a plurality of position indications corresponding to said plurality of segments.

35. A game apparatus with bonus indicator comprising:

a game having at least an element of chance and including a game controller;

a bonus indicator associated with said game, said bonus indicator being supported for rotation around an axis and having a surface providing a plurality of segments wherein at least one segment of said plurality of segments is a multiplier segment and wherein said game controller provides a multiple of an award when any one of said multiplier segments is indicated by said bonus indicator; and an absolute position detector including a rotatable member coupled to said wheel-shaped bonus indicator for rotation therewith, said rotatable member having indices corresponding to said plurality of segments.

36. A game apparatus with wheel-shaped indicator comprising:

a game having at least an element of chance;

a wheel-shaped indicator associated with said game, said wheel-shaped indicator being supported for rotation around an axis and having a surface providing a plurality of segments including at least one multiplier segment for multiplying a preexisting value;

a motor coupled to said wheel-shaped indicator for selectively rotating said wheel-shaped indicator; and a position detection means for detecting positions corresponding to said plurality of segments of said wheel-shaped indicator.

37. An apparatus comprising:

a body supported for rotation around an axis of rotation, said body being provided with a plurality of indicia including at least one multiplier indicia;

a fixed pointer adapted to point to a selected indicia of said plurality of indicia;

a motor adapted to selectively rotate said body to align said pointer with said at least one multiplier indicia to indicate a multiplied award; and an optical position detector including a light-modulating member coupled to said wheel-shaped indicator for rotation therewith, said light-modulating member including a plurality of position indications corresponding to said plurality of segments.

* * * * *

UNITED STATES PATENT AND TRADEMARK OFFICE

CERTIFICATE OF CORRECTION

PATENT NO. : 7,278,635 B2
APPLICATION NO. : 10/176100
DATED : October 9, 2007
INVENTOR(S) : Kelly et al.

It is certified that error appears in the above-identified patent and that said Letters Patent is hereby corrected as shown below:

Column 16,
Line 2, change “wheel-shaped indicator” to --body--; and
Line 5, change “segments” to --indicia--.

Signed and Sealed this

Fourteenth Day of October, 2008

JON W. DUDAS
*Director of the United States Patent and Trademark Office*